US006108500A

United States Patent [19]

Ohkama et al.

[11] Patent Number: 6,108,500

[45] **Date of Patent: *Aug. 22, 2000**

[54] IMAGE FORMING APPARATUS

[75] Inventors: Yuko Ohkama; Masami Takeda, both of Yokohama; Hiroto Hasegawa, Mishima; Yozo Hotta, Susono, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/993,158

[22] Filed: Dec. 18, 1997

[30] Foreign Application Priority Data

Dec. 20, 1996 [JP] Japan ..... 8-354756

[51] Int. Cl.[7] ..... G03G 15/20

[52] U.S. Cl. ..... 399/67

[58] Field of Search ..... 399/67, 68, 69, 399/320, 322, 328, 330, 331

[56] References Cited

U.S. PATENT DOCUMENTS

| | | | |
|---|---|---|---|
| 4,585,325 | 4/1986 | Euler | 399/69 |
| 4,719,489 | 1/1988 | Ohkubo et al. | 399/67 X |
| 5,138,392 | 8/1992 | Kinoshita et al. | 399/67 X |
| 5,300,995 | 4/1994 | Ohgita et al. | 399/331 |
| 5,623,333 | 4/1997 | Nagase et al. | 399/68 X |
| 5,742,865 | 4/1998 | Yajima et al. | 399/69 X |

*Primary Examiner*—Sandra Brase

*Attorney, Agent, or Firm*—Fitzpatrick, Cella, Harper & Scinto

[57] ABSTRACT

An image forming apparatus includes an image forming device for forming an image onto a recording material and a fixing device for fixing the image on the recording material. The fixing device has a rotating member for conveying the recording material, and a controller for controlling the factors related to the peripheral speeds of the rotating member in accordance with the information of the peripheral speeds thereof and the size of the recording material. With the structure thus arranged, it is possible to prevent image problems from taking place due to the difference in the sheet conveying speeds between the image transfer and fixation operations.

23 Claims, 20 Drawing Sheets

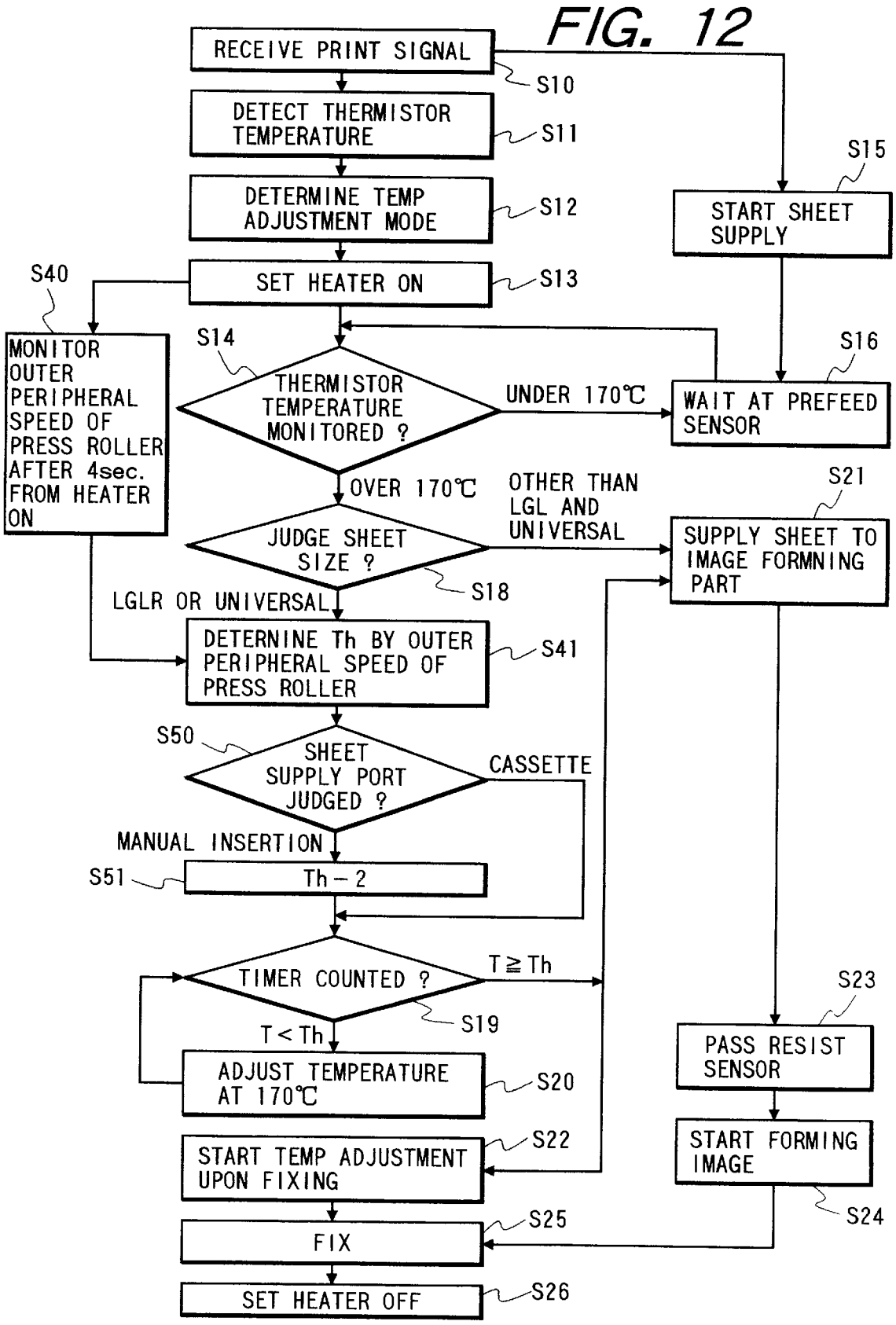
FIG. 12
RECEIVE PRINT SIGNAL
S10
DETECT THERMISTOR TEMPERATURE
S11
DETERMINE TEMP ADJUSTMENT MODE
S12
SET HEATER ON
S13
S15
START SHEET SUPPLY
S40
MONITOR OUTER PERIPHERAL SPEED OF PRESS ROLLER AFTER 4sec. FROM HEATER ON
S14
THERMISTOR TEMPERATURE MONITORED ?
UNDER 170℃
S16
WAIT AT PREFEED SENSOR
OVER 170℃
OTHER THAN LGL AND UNIVERSAL
S21
JUDGE SHEET SIZE ?
S18
SUPPLY SHEET TO IMAGE FORMNING PART
LGLR OR UNIVERSAL
DETERNINE Th BY OUTER PERIPHERAL SPEED OF PRESS ROLLER
S41
S50
SHEET SUPPLY PORT JUDGED ?
CASSETTE
MANUAL INSERTION
S51
Th − 2
TIMER COUNTED ?
T ≧ Th
S19
T < Th
ADJUST TEMPERATURE AT 170℃
S20
S23
PASS RESIST SENSOR
START FORMING IMAGE
S24
S22
START TEMP ADJUSTMENT UPON FIXING
S25
FIX
SET HEATER OFF
S26

IMAGE FORMING APPARATUS

BACKGROUND OF THE INVENTION

1. Field of the Invention

The present invention relates to an image forming apparatus, such as a copying machine, a printer. More particularly, the invention relates to an image forming apparatus provided with fixation means for fixing images recorded on a recording material by means of heat and pressure given to it.

2. Related Background Art

Conventionally, a large number of electro-photographic copying machines, printers, or the like have adopted a heat roller method or a film heating method as fixation means, which is a contact heating type having a good thermal efficiency and safety. In recent years, fixing apparatuses of a film heating type are widely in use particularly in consideration of energy saving.

A film heating type fixing apparatus of the kind is disclosed, for example, in Japanese Patent Laid-Open Application No. 63-313182, Japanese Patent Laid-Open Application No. 2-157878, Japanese Patent Laid-Open Application Nos. 4-44075 to 4-44083, and Japanese Patent Laid-Open Application Nos. 4-204980 to 4-204984, respectively. The apparatuses thus disclosed are such that a heat resistive film is closely in contact with a heating body by means of a pressure member to convey it slidably, while a transfer material that carries images yet to be fixed is brought into a pressure contact nipping unit formed by the heating body and the pressure member, which nips the heat resistive film, and the images yet to be fixed are then fixed upon the transfer material as permanent images by means of heat and pressure given to them from the heating body and the pressure contact nipping unit through the heat resistive film.

Such a fixing apparatus of a film heating type as described above is able to use a linear heating device having a lower heat capacity as its heating body, and a thin film having a lower heat capacity as its film to be adopted in this respect, hence making it possible to save the dissipation of electric power, as well as, to shorten the waiting time (that is, to provide a quick start capability). Among the film heating type fixing apparatuses, the pressure roller driving type, which feeds and carries a fixing film and a transfer material by driving a pressure roller, is able to eliminate the provision of rollers for use of fixing film suspension and rotation, film deviation controlling mechanism, and the like. Therefore, this type has advantages in making the apparatus smaller and reducing the costs of manufacture as well.

However, the image forming apparatus, which is provided with the fixing apparatus using the conventional pressure roller driving type film heating method, tends to allow the peripheral speeds of the pressure roller to vary due to its thermal expansion caused by heat generated by the heating body, because the elastic layer of the pressure roller of the apparatus is formed by heat resistive rubber, which makes the thermal expansion of the roller greater. Then, the conveying speed of a transfer material changes considerably in the fixing position depending on whether the pressure roller is in a cooled condition or in a heated condition.

FIG. 19 is a graph which illustrates the relationship between the changes of sheet conveying speed upon fixation using ordinary sheets supplied as the transfer material, and the sheet conveying speeds in the fixing and transfer portions. A solid line indicates the sheet conveying speeds Vfu in the fixing portion. A broken line indicates the sheet conveying speeds Vtr in the transfer portion.

As shown in FIG. 19, the sheet conveying speed Vfu in the fixing portion becomes faster gradually along the thermal expansion of the pressure roller from beginning with the sheet supply while the pressure roller is in a cooled condition. The thermal expansion thereof is increased as the number of supplied sheets increase. The speed is caused to vary continuously until the thermal expansion of the pressure roller reaches its saturation. There, the changes of the sheet conveying speed in the transfer portion are different depending on the structure of the pressure roller (such as the thickness of the elastic layer, the presence and absence of the release layer for use of the surface layer release), as well as the intervals at which sheets are supplied. However, the range of fluctuation of such speed from the supply of the first sheet up to the salutation of the thermal expansion is at least approximately 1.5% of the process speed, and as large as 4% thereof if the fluctuation should be large. As described above, if the sheet conveying speeds change in the fixing position depending on the heated conditions of the pressure roller, there occurs the difference in the sheet conveying speeds between the transfer and fixation. Hence, if one sheet is present in the transfer and fixing positions at a time, there occurs an event that the sheet is pushed in or pulled between them.

If the sheet conveying speed Vfu in the fixing portion is slower than the speed Vtr in the transfer portion so that the sheet is pushed into the fixing apparatus, that is, (Vtr>Vfu), the sheet is caused to sag between the transfer and fixation at P1 in FIG. 20A. Then, the difference in speeds $\Delta V2$ between the Vfu and Vtr becomes more than a specific value as indicated in the area A in FIG. 19. If this sagging becomes larger, the sheet is in contact with the surrounding structures, thus affecting the images yet to be fixed. In some cases, the so-called image scrubbing may take place as at P2 in FIG. 19.

In order to avoid such image scrubbing as this, it should be good enough if only the fixing speed Vfu for the first sheet is set more than the area A. However, if the speed Vfu in the fixing portion is set faster, the thermal expansion takes place on the pressure roller as shown in the area B in FIG. 19. Then, if the sheet conveying speed for fixation should become faster than the speed Vtr in the transfer portion, an event occurs that the sheet is pulled between the transfer and fixing portions as at P3 in FIG. 20B. As a result, the images on the trailing part of the sheet are caused to fall behind the transfer nipping, hence the density unevenness of half tone images or thicker images of characters is created in some cases.

The speed differences $\Delta V1$ and $\Delta V2$ between the transfer and fixation that may create such phenomena as described above are determined by the length of a sheet to be supplied, and the conveying distance between the transfer and fixing portions of an image forming apparatus. The longer the sub-scanning direction of a supplied sheet with respect to the length of the carrier path between the transfer and fixation, the more likely such phenomena in the smaller speed differences between $\Delta V1$ and $\Delta V2$, will take place.

In this respect, it may be possible to set a sufficient length of the carrier path between the transfer and fixation. In this case, however, the size of the image forming apparatus should be made extremely larger. This is not desirable after all.

Also, the thickness of the elastic layer of the pressure roller may be made thinner so as to suppress the thermal expansion of the pressure roller. Then, the speed changes in the fixing portion are made smaller. On this assumption, it is conceivable to set the fixing speeds within a range where no image problems may be encountered. However, if the thickness of the pressure roller is made thinner, there are some cases where no sufficient fixation is obtainable due to the inability of securing a good nipping condition needed for an intended fixation. The higher the process speeds of an image forming apparatus that particularly needs a wider fixation nipping, the more it becomes difficult to establish compatibility between the speed changes and the fixing capability.

Also, conceivably, it is made possible to prevent the sheet conveying speeds from being varied for fixation upon printing, while maintaining the pressure roller in a state that it is allowed to be sufficiently expanded thermally at all times. In this case, however, an idle rotation is needed for the pressure roller for a period of several minutes to enable its thermal expansion to reach saturation. At the same time, the pressure roller should be heated at specific intervals even when it is not engaged in printing. This heating is needed for maintaining the thermally expanded condition of the pressure roller. Then, in some cases, there may take place the inability of demonstrating the fundamental characteristics of a film heating type fixing apparatus that uses a fixing film having an extremely small heat capacity in order to make the rising time of the apparatus shorter for the suppression of electric power dissipation.

SUMMARY OF THE INVENTION

Therefore, with a view to solving the problems described above, the present invention is designed and aimed at the provision of an image forming apparatus capable of maintaining good fixing ability without making the image forming apparatus larger, and also, capable of making the most of the characteristics of a film heating type fixing apparatus whose power dissipation is smaller without crating any image scrubbing, density unevenness, or the like.

It is another object of the present invention to provide an image forming apparatus comprising:

- image forming means for forming an image onto a recording material;
- fixing means for fixing the image on the recording material, this fixing means having a rotating member for conveying the recording material; and
- control means for controlling the factors related to the peripheral speeds of the rotating member in accordance with the information of the peripheral speeds thereof and the size of the recording material.

Other objectives and advantages besides those discussed above will be apparent to those skilled in the art from the description of a preferred embodiment of the invention which follows. In the description, reference is made to accompanying drawings, which form a part hereof, and which illustrate an example of the invention. Such example, however, is not exhaustive of the various embodiments of the invention, and therefore reference is made to the claims which follow the description for determining the scope of the invention.

BRIEF DESCRIPTION OF THE DRAWINGS

FIG. 12 is a flowchart which shows the control of the main body in accordance with a fourth embodiment of the present invention.

DETAILED DESCRIPTION OF THE PREFERRED EMBODIMENTS

Now, hereinafter, the detailed description will be made of the embodiments of a multiple image forming apparatus in accordance with the present invention.

Figure 1:
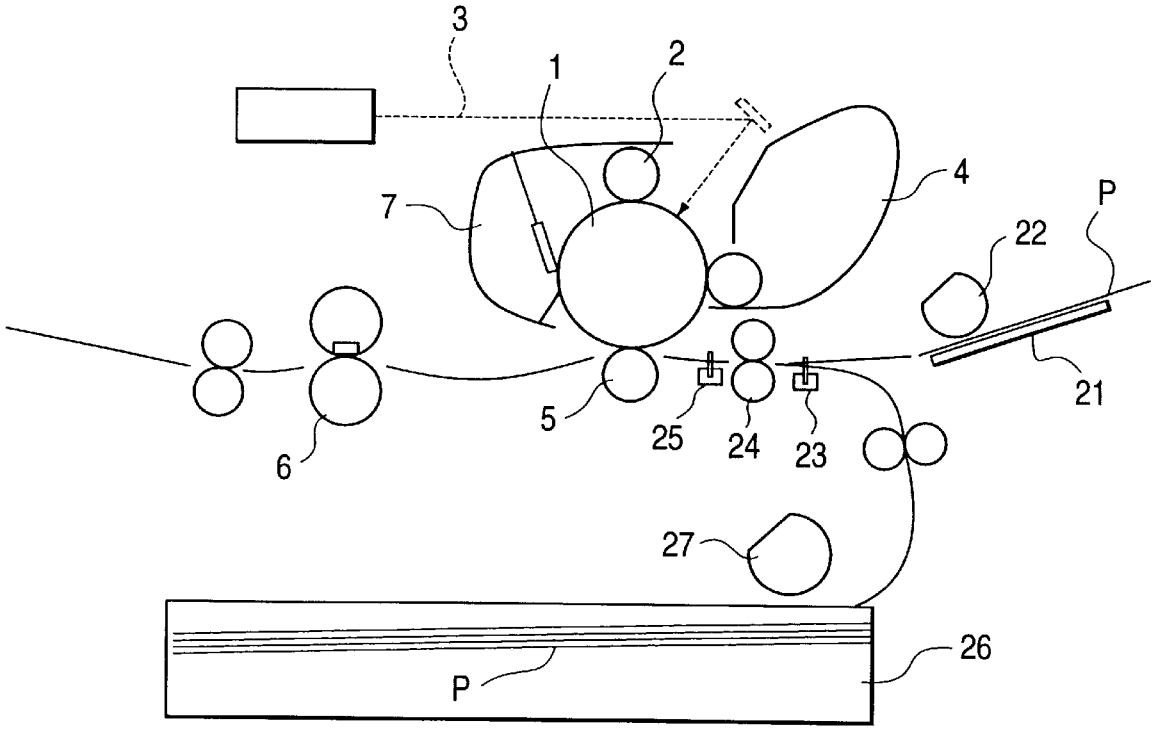
FIG. 1 is a view which schematically shows the structure of an image forming apparatus in accordance with one embodiment of the present invention.

In FIG. 1, a reference numeral 1 designates a photosensitive drum serving as an image carrier device, which is structured by forming OPC, amorphous Si, or some other photosensitive material on a cylindrical substrate of aluminum, nickel, or the like. At first, the surface of the photosensitive drum 1 is charged uniformly by means of a charging roller 2 serving as a charging device. Then, the laser beams 3 that serves as exposure means are on/off controlled in accordance with image information to effectuate the scanning exposure, thus the electrostatic latent images are formed on the photosensitive drum 1. The electrostatic latent images are developed by a development device 4 to make them visible. As a method of development, there is adopted the jumping development method, the two-component development method, or FEED development, among some others, which is often used by the combination of image exposure and reversed development. A paper sheet P serving as a recording material is withdrawn from a manual feeding tray 21 or a cassette 26 by means of sheet feeding rollers 22 and 27. Then, the sheet is on standby until the completion of fixing temperature rising by means of a pre-feeding sensor 23. After that, the sheet is carried to the image formation unit through resist rollers 24. The sheet P is supplied by means of a resist sensor 25 to the transfer nipping unit formed by the photo-sensitive drum 1 and a transfer roller 5 in synchronism with the toner images formed on the surface of the photosensitive drum 1. In the transfer nipping unit, the toner images on the photosensitive drum 1 are transferred to the sheet P by the function of transferring bias provided by an electric power source (not shown). The sheet P that holds the toner images is carried to the fixing apparatus 6. Then, the toner images are fixed on the sheet P as the permanent images by the application of heat and pressure exerted by the fixing apparatus. Subsequently, the sheet is exhausted outside the apparatus. On the other hand, the remainders of transfer toner still remaining on the photosensitive drum 1 is removed by use of a cleaning device 7 from the surface of the photosensitive drum 1.

Now, in conjunction with FIG. 2, the description will be made of the structure of the film heating type fixing apparatus using the pressure roller driving method to which the present invention is applicable.

Figure 2:
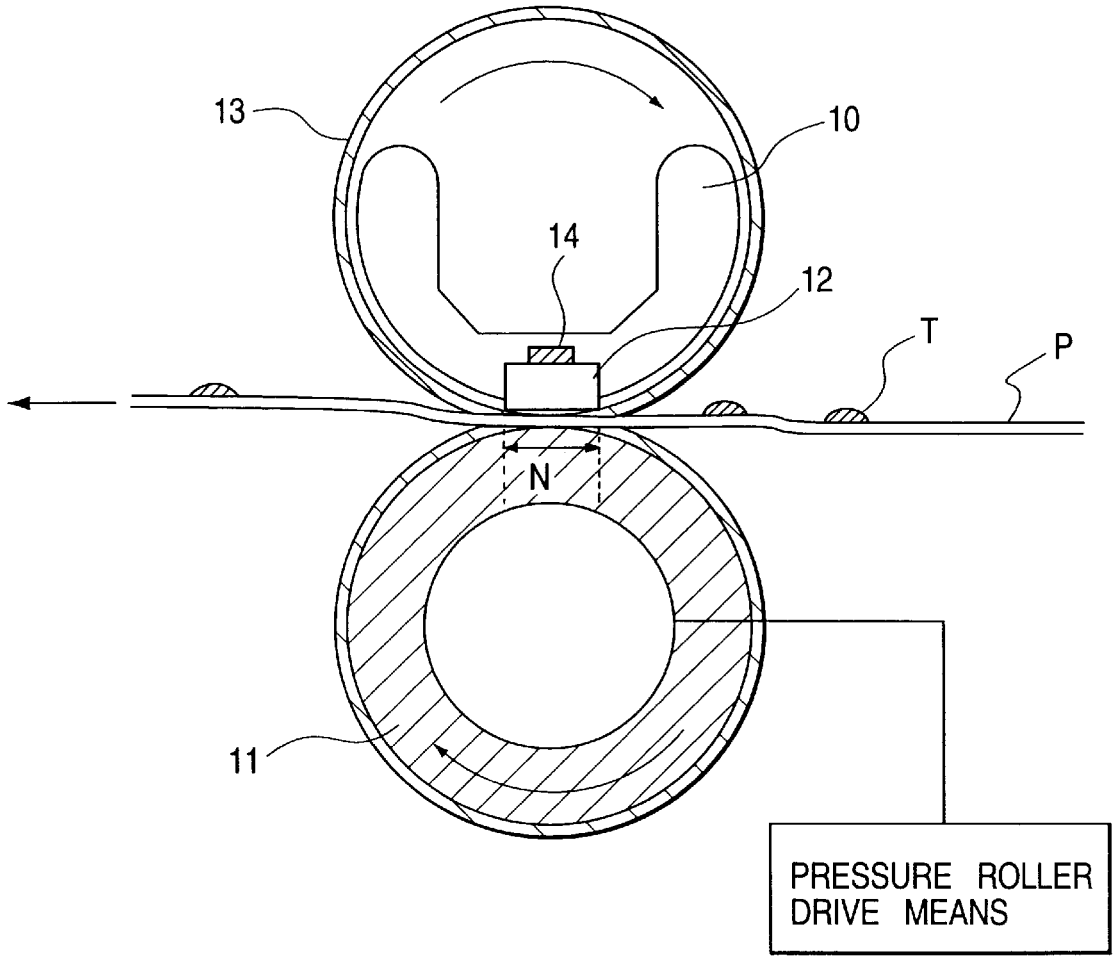
FIG. 2 is a view which schematically shows the structure of a film heating type fixing apparatus in accordance with one embodiment of the present invention.

In FIG. 2, a reference numeral 13 designates an endless belt type heat resistive film. This film is fitted over a semi-circular film guide member 10 with a room provided for the peripheral length of the film. Here, PTFE, PFA, PPS or some other single layer film, which is provided with good heat resistance, releasability, strength, durability, and the like, or a complex layered film produced by coating PTFE, PFA, FEP, or the like, as release layer, on the surface of polyimide, polyamide, PEEK, PES film or the like, is used as the film 13, the thickness of which is arranged to be 100 $\mu$m or less in total, or preferably, 40 $\mu$m or less and 20 $\mu$m or more, hence making the heat capacity of the film smaller for the enhancement of the quick start capability.

A reference numeral 12 designates a ceramic heater serving as heating body, which is formed by laminating one after another a heating device being printed heat generating paste on a ceramic substrate, and glass coating layer to protect the heating device and secure insulation. This heater 12 generates heat when the AC current having a controlled power is applied to the heating device on the heater. On the reverse side of the ceramic substrate, a chip thermistor 14 is bonded. The chip thermistor 14 detects the temperature changes within a specific period of time when the power to the heater is turned on or off, while the sheet supply is at rest. In accordance with the detected result, the target temperature of the heater is determined in order to control heater driving means (not shown). In this way, the structure is arranged to control the power supply to the heater for the maintenance of the target temperature (printing temperature).

A reference numeral 11 designates a pressure roller serving as a pressurized rotative body. On the core formed by Fe, Al, SUS, or some other metal, an elastic layer, which is formed by heat resistive rubber, such as silicone rubber, or a spongy elastic layer made by foaming silicone rubber, is provided to constitute the rotative device. On such elastic layer, it may be possible to provide a heat resistive releasing layer formed by PFT, PTFE, FEP, or some other fluororesin. The pressure roller 11 is pressed by a spring (not shown) to be in contact with the heater 12 side. The roller is driven by pressure roller driving means to rotate. Here, the structure is arranged so that by means of this pressure roller 11, the sheet P and the fixing film 13 are carried by following the rotation of the pressure roller.

The toner images yet to be fixed is heated and pressed in the pressure contact nipping unit arranged by the heating portion (film and ceramic heater) of the fixing apparatus, as well as by the pressure roller, and then, the images are fixed on the sheet P. After fixation, the sheet is exhausted outside the apparatus.

Hereunder, the description will be made of the specific examples of the main body control to which the present invention is applicable.

(First Embodiment)

At first, in conjunction with FIG. 1 to FIG. 7, the description will be made of a first embodiment in accordance with the present invention. For the present embodiment, an ordinary paper sheet is used as a recording material. In accordance with the result of detection as to the size of the sheet to be supplied, the heating period of the pressure roller is extended upon fixation rising only when the size of the supplied sheet thus detected is longer than a specific value, that is, the legal size (216×365 mm), for example, hence making it possible to prevent images from being scrubbed due to the difference in sheet conveying speeds between the transfer and fixation. If the size of the sheet is found smaller, there is no problem, because the sheet is carried through the nipping portion of the transfer unit before it is rubbed by residual toner container or the like even when the sheet conveying speed is slower in the fixing unit than that of the transfer unit.

Also, the image scrubbing that may take place due to the slower conveying speed in the fixing portion is a phenomenon that appears in the morning when the fixing apparatus is used for the first time, that is, the pressure roller is not warmed up essentially (as if the first run in the morning). When the sheet supply begins with the pressure roller being warmed up to thermally expand it to a certain extent, no image scrubbing occurs. Therefore, the control, which enables the heating period of the pressure roller to be extended for the supplied sheet which is longer than the legal size, should only be made when the fixing apparatus is in the first run in the morning condition. If the sheet supply begins in states other than this condition, the printing and fixation are performed in the usual sequence so as to prevent the pressure roller from being thermally expanded excessively even when the size of the supplied sheet is found to be longer than the legal size.

In accordance with the present embodiment, the condition of the fixing apparatus at the initiation of the sheet supply is determined by the detected temperature of the thermistor immediately after the reception of printing signals. Here, in the present embodiment, if the detected temperature of the thermistor 14 is 80° C. or less, the apparatus is assumed to be in the first run in the morning condition.

Also, the decision on the size of the sheet to be supplied is made by means of the cassette size detection or information form the host computer as to the sheet size designation. If no decision can be made on the sheet size, it is arranged to extend the heating period of the pressure roller as in the case of legal size performance on the assumption that the size of supplied sheet is the universal size.

Figure 3:
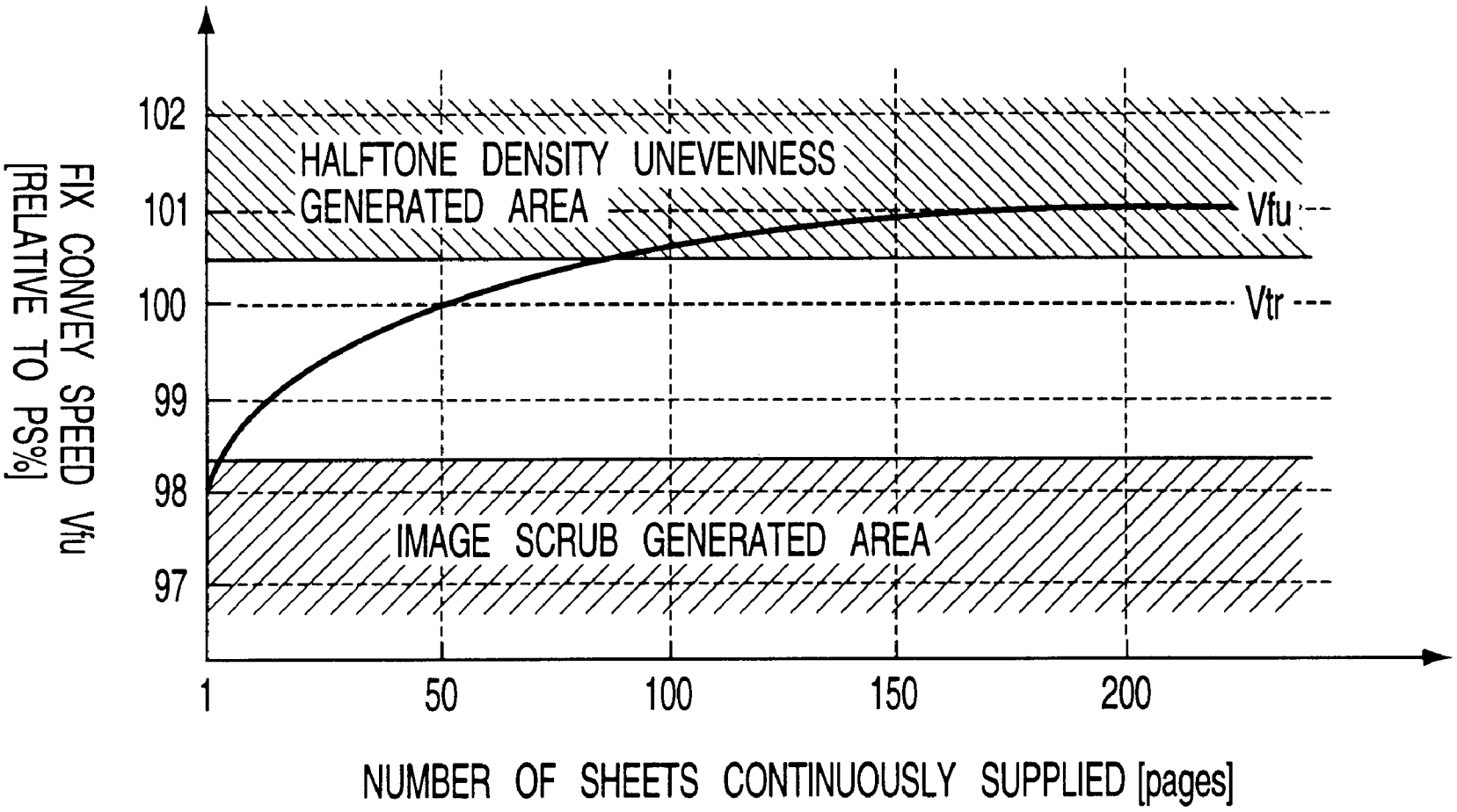
FIG. 3 is a graph which illustrates the transfer material conveying speeds in the transfer and fixing portions, and the area where the image problems are created in accordance with a first embodiment of the present invention.

Now, hereunder, the specific examples will be described. FIG. 3 shows the changes of sheet conveying speed Vfu in the fixation when the legal size sheets (each having a dimension of 216 mm width ×256 mm length) are continuously supplied beginning with the condition of the first run in the morning. In this case, the process is arranged as given below. In other words, a polyimide seamless film whose thickness is 40 $\mu$m and outer diameter is 20 mm is used as the heat resistive film 13; as the pressure roller 11, a silicone rubber roller, having the outer diameter 20 mm and the thickness of its elastic layer t=5 mm, is used with the PFA tube of 30 $\mu$m thick being covered over the surface of the roller as releasing layer; the process speed is set at 70 mm/sec; the sheet interval is 50 mm; the pre-feeding temperature is Tpf=170° C.; and at the time of fixation, the initial adjustment temperature is 200° C. and the final adjustment temperature is 150° C., respectively. Then, the Vfu is approximately 98% with respect to the process speed for the first sheet immediately after starting in the condition of the first run in the morning, and the Vfu is approximately 101% upon the saturated thermal expansion. In this case, the range of the speed variation is ΔVfu=3% in the fixing portion.

Now, for an image forming apparatus that uses the fixing apparatus structured as described above, having the 100% sheet conveying speed to the process speed in the transfer portion with the sheet carrier path of 140 mm between the transfer and fixation, the range in which image scrubbing or density unevenness occurs is as shown in the Table 1 where legally sized sheets are supplied from a cassette.

TABLE 1

| Vfu | ΔV = Vfu − Vtr | Image Problems |
|---|---|---|
| 98.3% or less | −1.7% | Image scrubbing |
| 100.6% or more | +0.6% | Half tone density unevenness |

Taking the possible occurrence of such image scrubbing or density unevenness as described above into consideration, it is arranged for the present embodiment to set the size, material, and others of the pressure roller so that the sheet conveying speed Vfumin for the first sheet immediately after the sheet supply begins in the condition of the first run in the morning may become 97.5% to the process speed, and that the Vfumax upon thermal expansion may become 100.5%. Then, the control is made to adjust the heating period of the pressure roller so that the Vfumin at the initiation of the sheet supply of the legal size sheets in the condition of the first run in the morning should become 98.3% or more to the process speed, not 97.5% to it.

Figure 4:
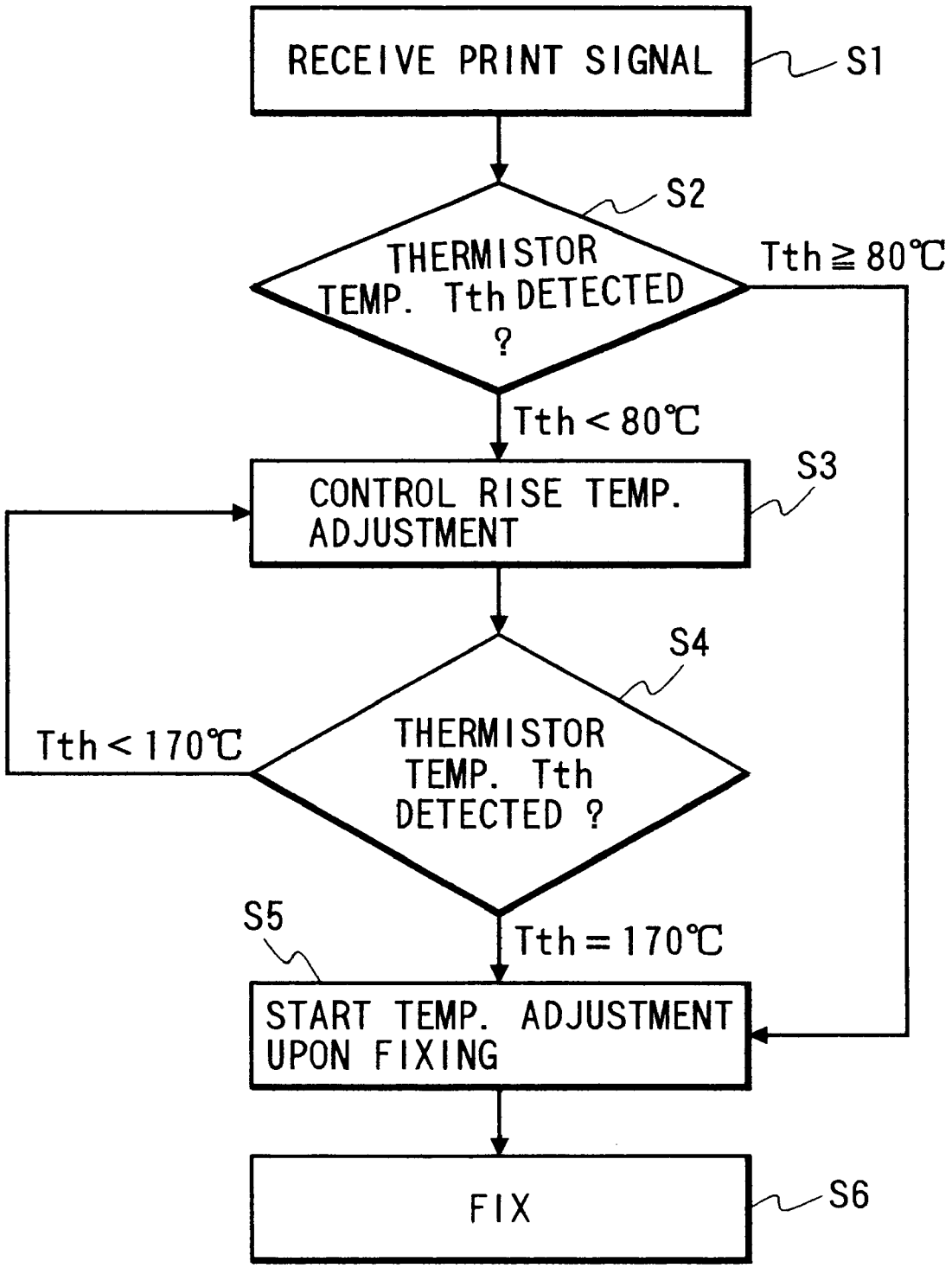
FIG. 4 is a flowchart which shows the fixing temperature control in accordance with the first embodiment of the present invention.

FIG. 4 is a flowchart which schematically shows the temperature control of the fixing apparatus of the image forming apparatus in accordance with the present embodiment.

When a printing signal is received (step S1), the temperature of the thermistor is detected at first (step S2). If the result of the detection indicates that the thermistor temperature is 80° C. or more, the heater is turned on to start the temperature adjustment for fixation (step S5), and at the same time, the sheet is supplied for image formation, and then, for fixation (step S6).

On the other hand, if the thermistor temperature is less than 80° C. immediately after the reception of the printing signal, the heater is turned on to begin the temperature adjustment for rising (step S3) to enable the pressure roller 11 to be thermally expanded, thus preventing images from being scrubbed. During this period, the sheet is carried to the position of the pre-feeding sensor 23 to keep it on standby in that position until the temperature adjustment for fixation begins. Then, the rising temperature control is performed, and when the thermistor temperature reaches the pre-feeding temperature of 170° C., the temperature adjustment is allowed to shift to the one for fixation (steps S4 and S5). Hence, the sheet, which is on standby in the position of the pre-feeding sensor 23, is carried to the image formation unit for the execution of transfer and fixation (step S6).

Thus, in accordance with the present embodiment, if the detected thermistor temperature is less than 80° C. as referred to in the preceding paragraph, it is determined that the apparatus in the condition of the first run in the morning, and then, the heating period of the pressure roller 11 is extended by means of an idle rotation heating mode where the pressure roller 11 is caused to rotate idly to be heated further at the pre-feeding temperature before the initiation of the temperature adjustment for fixation subsequent to the thermistor temperature having arrived at the pre-feeding temperature of 170° C.

Figure 5:
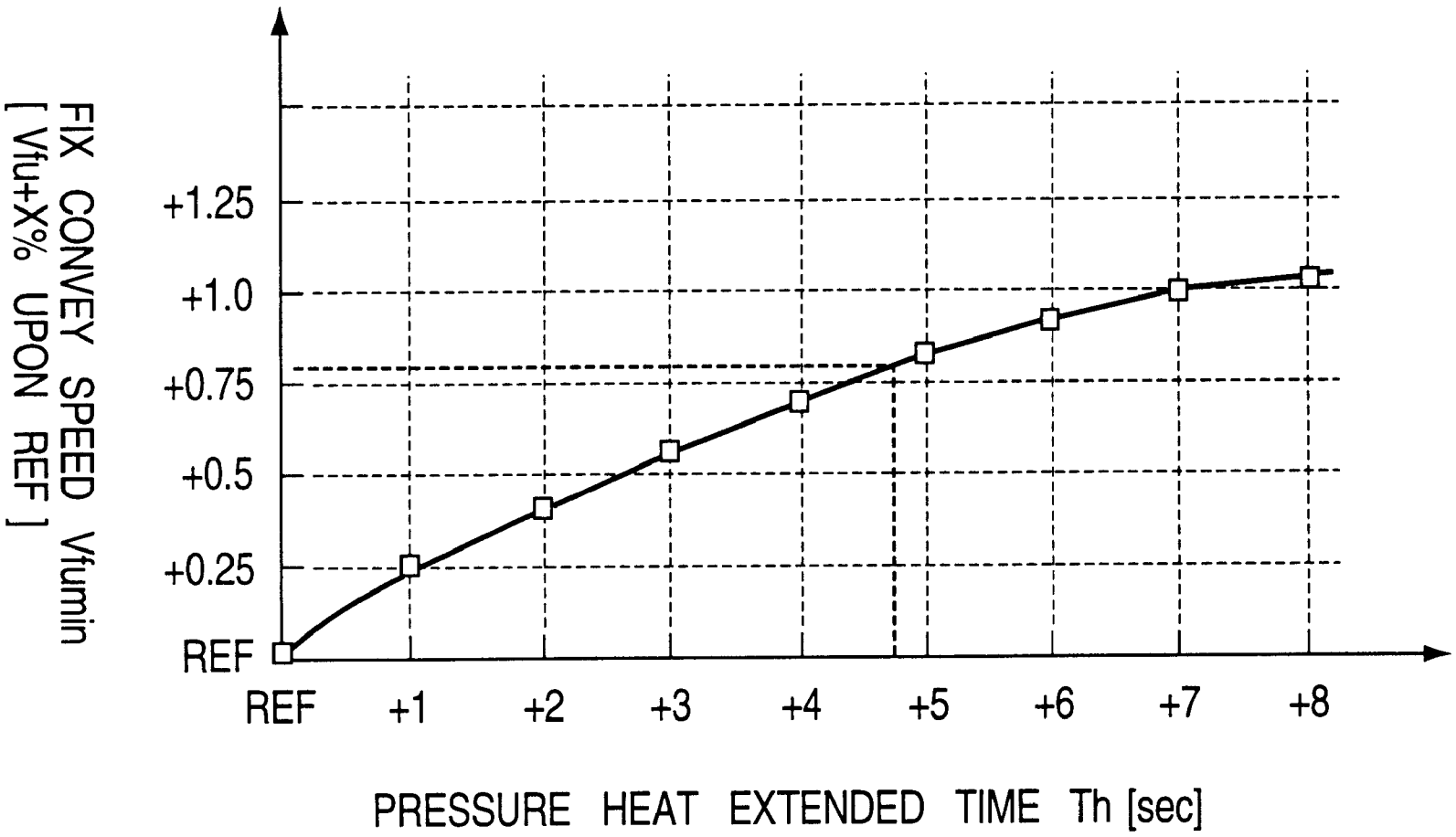
FIG. 5 is a graph which illustrates the relationship between the pressure heating extended time and the conveying speeds for fixation in accordance with the first embodiment of the present invention.

FIG. 5 is a graph which shows the relationship between the extended period Th of the pressure heating and the conveying speed Vfumin of the first sheet for fixation when the fixing apparatus is caused to rise from the condition of the first run in the morning. Here, the extended period Th of the pressure heating means the period of time during which the pressure roller is idly rotated to be heated to 170° C., while the temperature adjustment is being made constantly. Here, the measurement of such temperature adjustment begins when the thermistor temperature has reached the pre-feeding adjustment temperature for the fixing apparatus which is required to rise from the first run in the morning condition.

In order to make the Vfumin a speed not to cause any image scrubbing (that is, 98.3% or more) by setting the fixing speed in accordance with the present embodiment, it is necessary to increase the fixing speed Vfumin by +0.8% (=98.3%−97.5%) at the time of executing the reference control. To this end, it should be good enough if only the extended period of the pressure heating is set at approximately 4.7 seconds or more as readily understandable from the representation of the graph shown in FIG. 5. For the present embodiment, the extended period Th of the pressure heating is set at five seconds with a slight margin taken into consideration for the prevention of image scrubbing.

Figure 6:
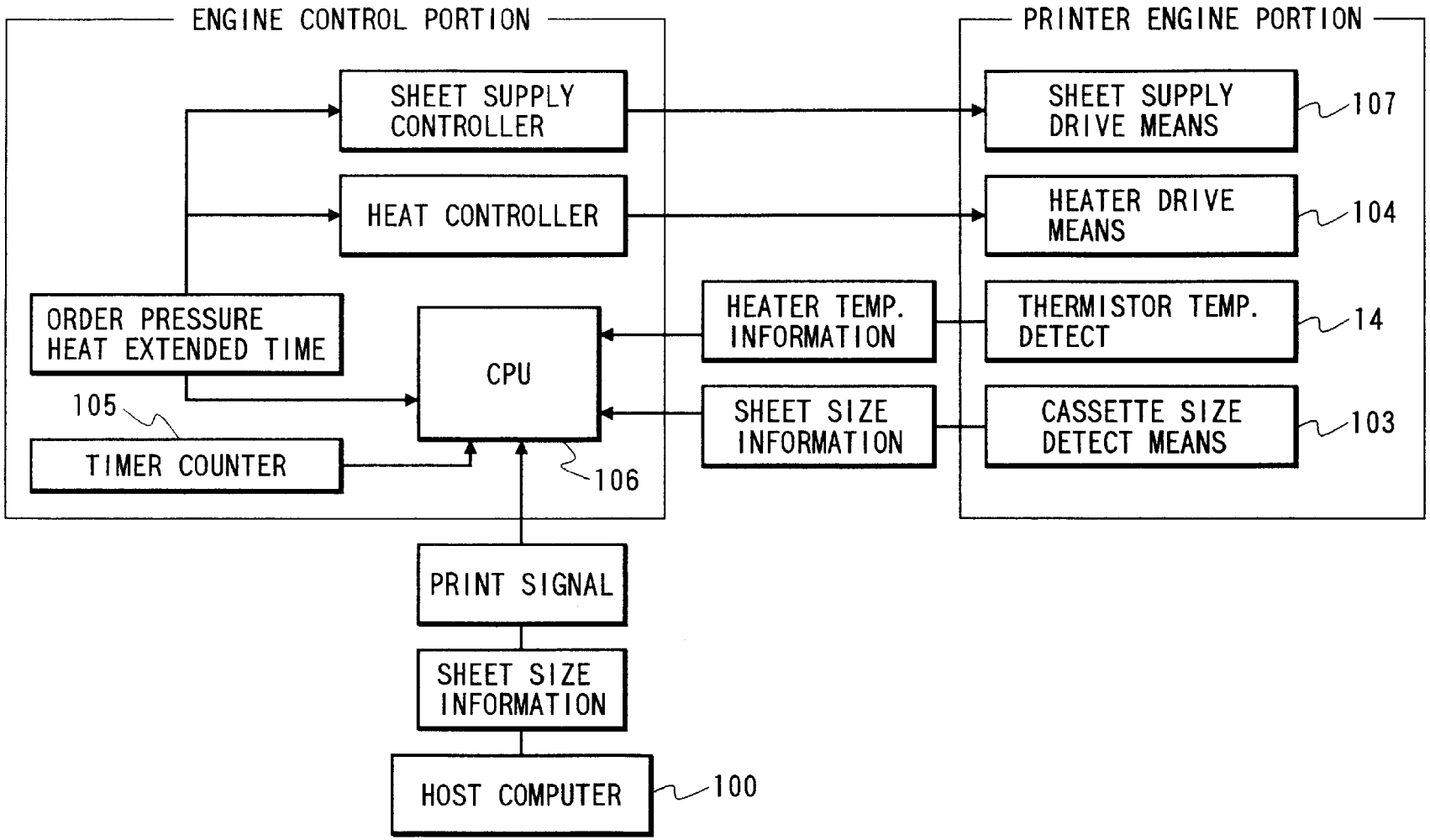
FIG. 6 is a block diagram which shows the control of the main body in accordance with the first embodiment of the present invention.

FIG. 6 is a block diagram which shows the main body control in accordance with the present embodiment for the execution of the control as described above. When a printing signal is received from the host computer 100, the CPU 106 drives the sheet supply driving means 107 to start supplying sheets. Also, at the same time, the results of detection are inputted into the CPU from the cassette size detection means 103, as well as from the thermistor temperature detection means 14. Further, if there is any information from the host computer 100 that designates the sheet size or the like, this information is also inputted into the CPU 106. Based upon these pieces of information, the CPU 106 determines the current condition of the fixing apparatus, and the size of sheet to be supplied, and decides on the extended period of pressure heating. Then, heater driving means 104 is driven and controlled to energize the heat generating device 12 of the heater as required. If the heating period should be extended, the pressure heating roller 11 is heated to and for a desired temperature and time by use of the thermistor temperature detection means 14 and timer counter 105. Then, after the extended period of pressure heating having passed a given value, the sheet is again carried by use of the sheet supply driving means 107 for fixation.

Figure 7:
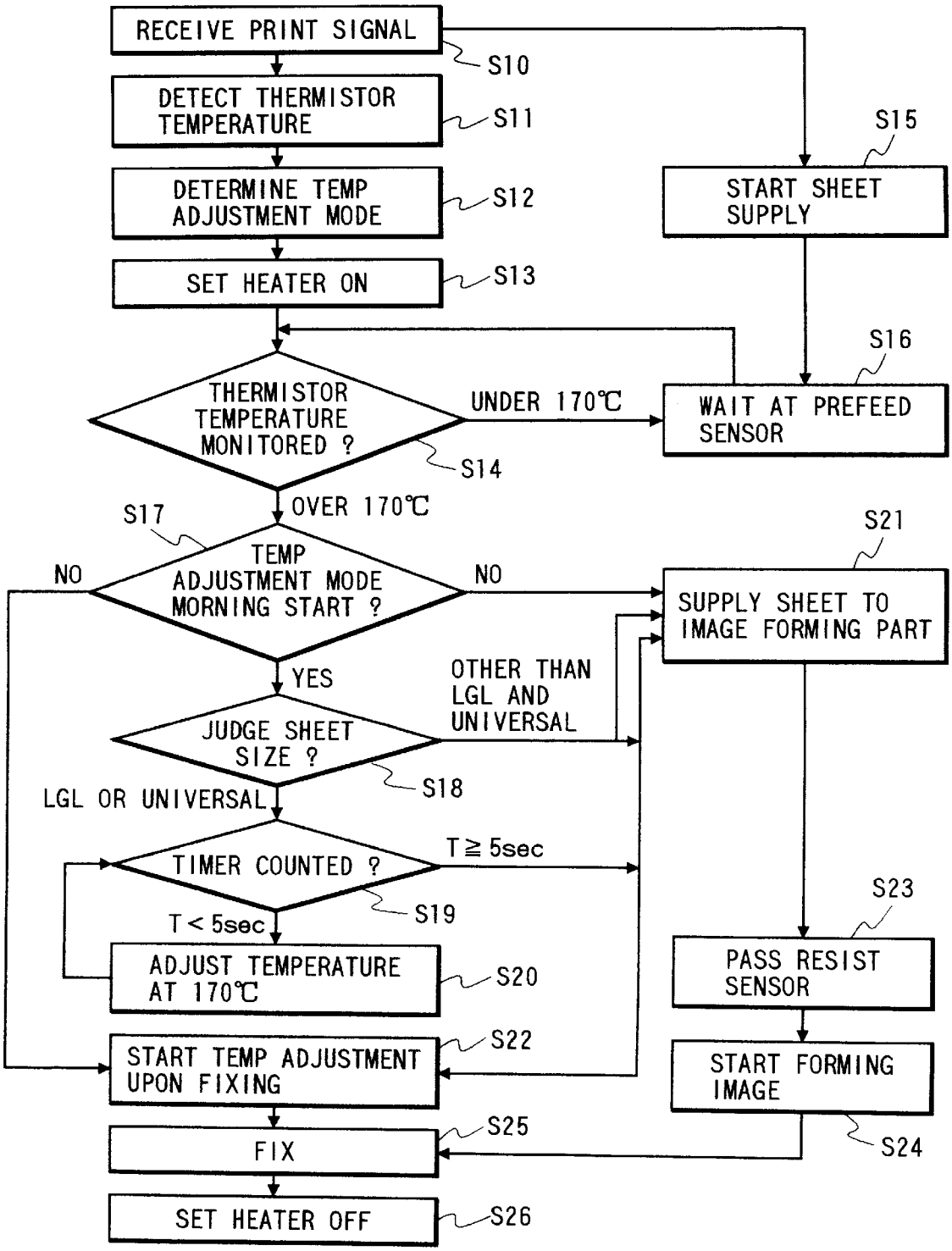
FIG. 7 is a flowchart which shows the control of the main body in accordance with the first embodiment of the present invention.

Now, in conjunction with the flowchart shown in FIG. 7, a description will be made of the sequence of the main body control in accordance with the present embodiment. After having received a printing signal (step S10), the thermistor temperature is detected (step S11) to determine whether the apparatus is in the usual temperature adjustment mode or in the first run in the morning mode with the reference temperature of 80° C. as described above (step S12). Thus, the control is started, and the heater 12 is energized (step S13).

During the energizing period of the heater 12, the thermistor temperature is monitored per specific cycle (step S14). During this period, the sheet is supplied (step S15) to be on standby in the position of the pre-feeding sensor 23 (step S16).

Then, when the monitored result of the thermistor temperature becomes more than the pre-feeding adjustment temperature Tpf° C. (170° C. for the present embodiment), the temperature adjustment mode is confirmed (step S17). If the confirmed mode is in the first run in the morning condition, the timer counter is actuated. Then, there is a fear that images may be scrubbed as described above if the sheet size found (in the step S18) is legal size or the universal size. Thus, during the period Th (5 seconds in accordance with the present embodiment), the temperature adjustment is continued at Tpf° C. (step S19 and step S20) so that the pressure roller is caused to rotate idly to be heated, and the heating period of the pressure roller is extended.

Subsequently, when the specific period Th of pressure heating extension has elapsed, the sheet is carried from the position of the pre-feeding sensor 23 (step S21), and at the same time, the temperature adjustment of the heater is started (step S22), hence shifting it to the temperature adjustment for fixation. After the sheet has passed the resist sensor 25 (step S23), the image formation begins (step S24), and after images are transferred onto the sheet, fixation is executed (step S25).

On the other hand, even when the result of the confirmed mode of the temperature adjustment (step S17) is in the first run in the morning condition, there is no fear that image scrubbing may take place as described above if the sheet size found (in the step S18) is smaller than legal size or universal size or the result of the confirmed temperature adjustment mode (step S17) is the one for the usual temperature adjustment. Therefore, when the current event is for the usual temperature adjustment mode, the control is allowed to shift to the temperature adjustment for fixation as it is after the detected result of thermistor temperature becomes the pre-feeding adjustment temperature Tpf° C. or if the size of supplied sheet is other than legal size or universal size, the control shifts to the temperature adjustment for fixation as it is after the size of supplied sheet has been determined. At the same time, the sheet conveyance and image formation are started, thus executing fixation (step S25).

Then, in either cases of temperature adjustment modes, the fixation temperature adjustment is continued if the next printing signal is received upon the completion of the current fixation. However, if no printing signal is received at that time, the power supply to the heater is turned off (step S26).

With the sequence described above, 400 legally sized sheets are supplied continuously in order to confirm the result of performance. Then, good results are obtained without any image problems, such as image scrubbing, half tone density unevenness.

As described above, when the fixing apparatus is actuated to rise from the state where the pressure roller is cooled as in the first run in the morning condition, and also, the size of supplied sheet is larger, it is possible to set the speed between the transfer and fixation so as to avoid any image problems by extending the heating period of the pressure roller within the range of each of the fixation speeds. Also, if the pressure roller is already warmed or the size of supplied sheet presents no fear that any image scrubbing may take place, printing is performed by the pressure roller for the usual heating period, hence making it possible to shorten the fast printing time which is a time required for the completion of printing after having received printing signal.

(Second Embodiment)

Figure 8:
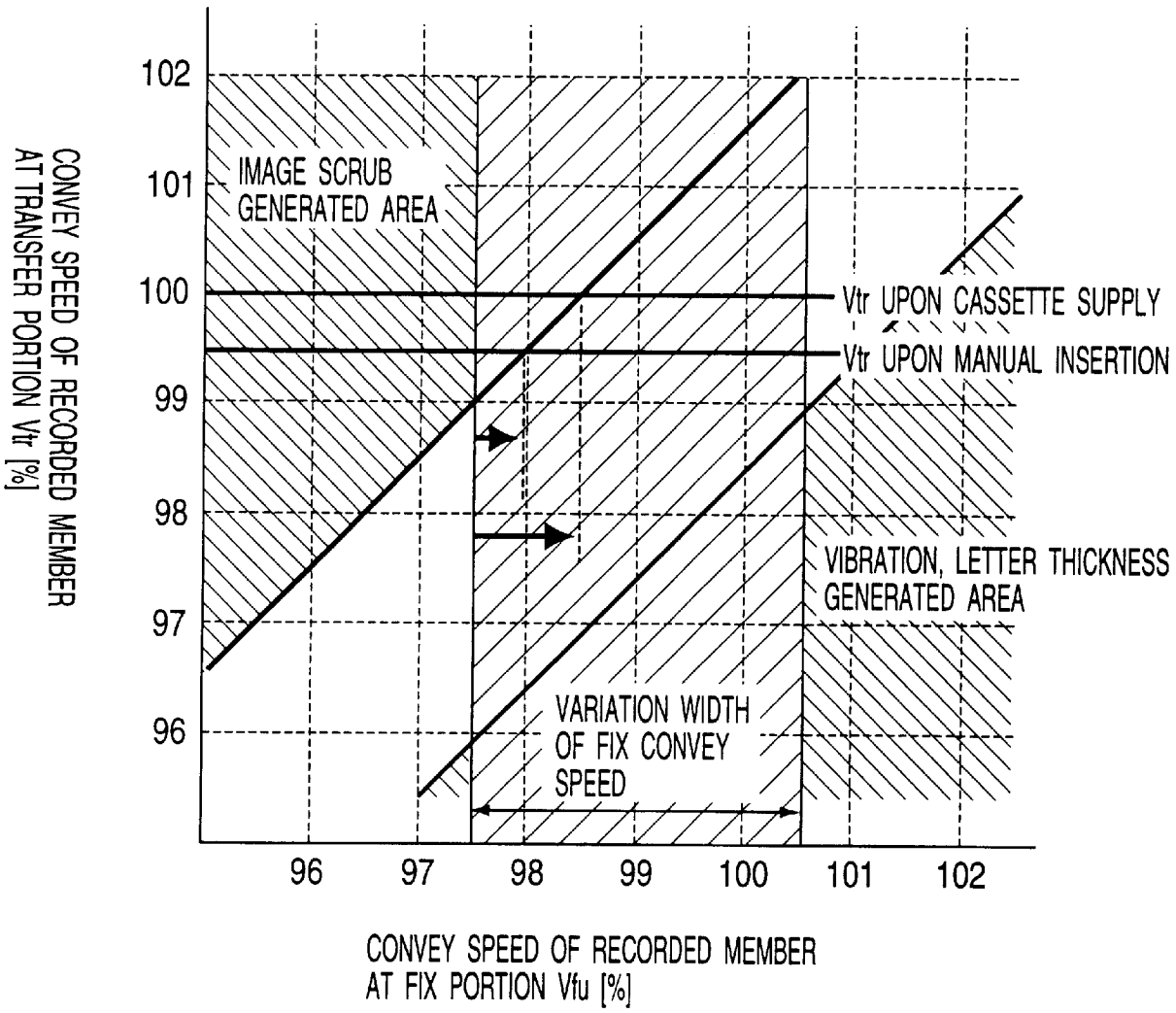
FIG. 8 is a graph which illustrates the transfer material conveying speeds in the transfer and fixing portions, and the area where the image problems are created in accordance with a second embodiment of the present invention.
Figure 9:
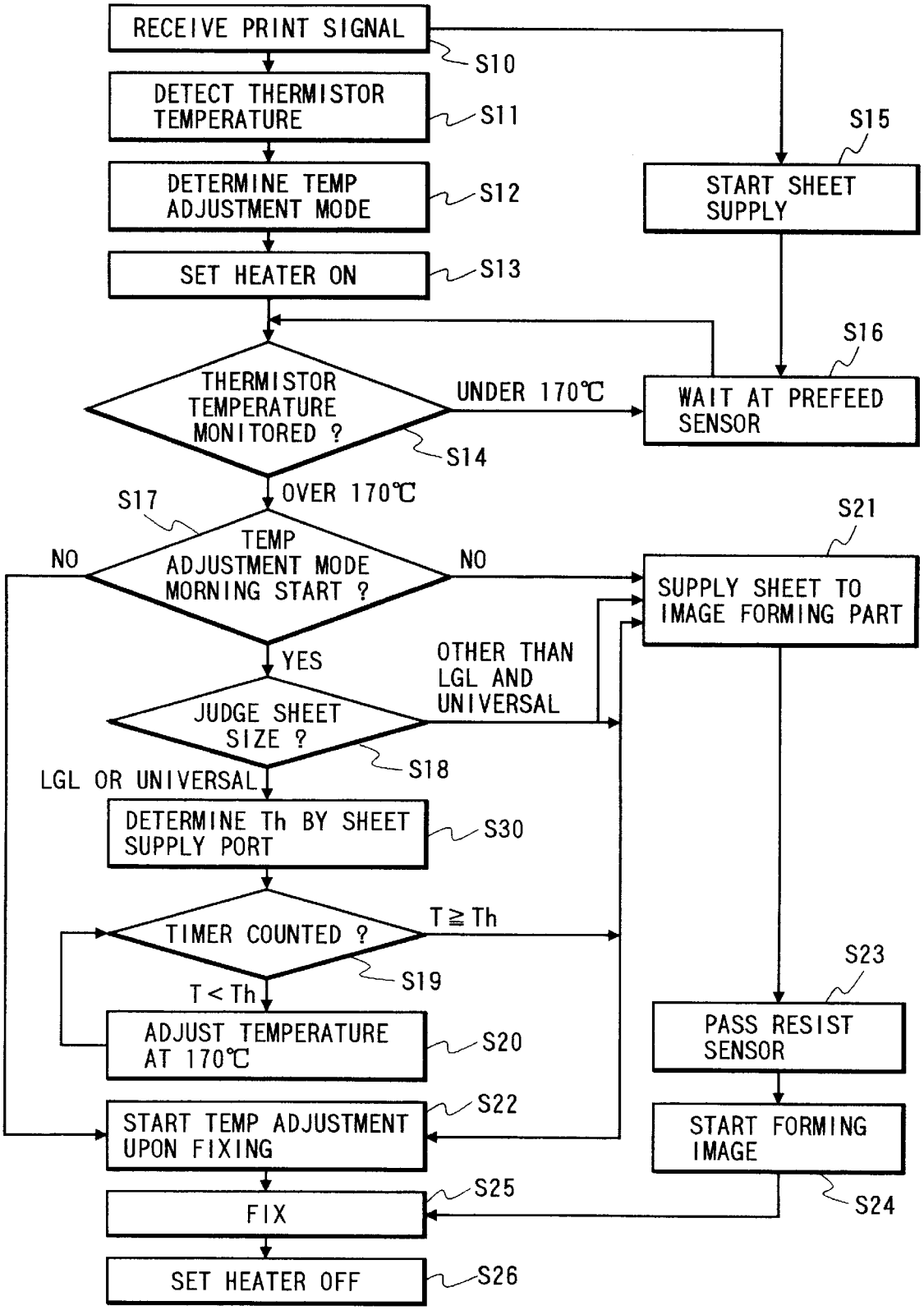
FIG. 9 is a flowchart which shows the fixing temperature control in accordance with the second embodiment of the present invention.

Now, in conjunction with FIG. 8 and FIG. 9, a description will be made of a second embodiment in accordance with the present invention. For the present embodiment, an example is shown. In this example, an image forming apparatus, which is provided with a plurality of sheet supply openings, is arranged to change the heating periods of the pressure roller upon fixation rising corresponding to the size of a sheet to be supplied as a recording material, as well as to the sheet supply opening to be used.

Since the structures of the fixing apparatus and image forming apparatus of the present embodiment are the same as those of the first embodiment, the description of the structural arrangements will be omitted for the second embodiment. Also, for the present embodiment, the extended heating period is adopted for the pressure roller only when the fixing apparatus should begin the sheet supply in such condition as the first run in the morning as in the first embodiment.

The image forming apparatus shown for the present embodiment is provided with two sheet supply openings, one for the cassette use and another for the manual insertion.

In the Table 2, the measured values of the sheet conveying speeds Vtr are shown for each of the legally sized sheets supplied from each sheet supply opening. The values are taken when the leading, intermediate, and trailing parts have passed the transfer portion, respectively. Here, those values are shown in terms of each ratio between the actual value of the sheet conveying speeds measured by means of laser Doppler speedometer immediately after the transfer portion and the process speed.

TABLE 2

| | Vtr | | |
|---|---|---|---|
| Supply Opening | Leading part (Leading end to 100 mm) | Intermediate part (150 to 250 mm) | Trailing part (265 mm to trailing end) |
| Cassette | 100% | 100% | 100% |
| Manual insertion tray | 99.5% | 99.5% | 100% |

In accordance with this table, the image forming apparatus of the present embodiment has a distance of as long as 280 mm between the cassette sheet feed roller and the transfer portion when the sheet is supplied from the cassette. Therefore, the back tension that exists over the sheet feed roller and the transfer portion, that is, the tension exerted on the sheet by the sheet feed roller, is small. Hence, up to the transfer portion, the sheet is carried at a constant speed of almost 100% from the leading end to the trailing end of the sheet. On the other hand, when a sheet is supplied by means of the manual insertion, the distance is as short as 100 mm between the sheet feed roller for manual use and the transfer portion. Therefore, the back tension is exerted by the sheet feed roller from the leading end to the intermediate part. Thus, the conveying speed is made slower, which is reduced to 99.5% due to the influence of such back tension. For the image forming apparatus of the present embodiment, therefore, the minimum conveying speed, which is required for the prevention of the image scrubbing of the first sheet in the fixing portion in the first run in the morning, is made different depending on the sheet supply openings as shown in FIG. 8.

The Table 3 shows the minimum sheet conveying speed Vfumin, which is required for the prevention of the image scrubbing in the fixing portion with respect to Vtr at each of the sheet supply openings, as well as the speed difference ΔVfumin between the Vfumin and the rising speed of the fixing apparatus of 97.5% in the first run in the morning.

TABLE 3

| Sheet Supply Opening | Vfumin | ΔVfumin | Th |
|---|---|---|---|
| Cassette | 98.5% | 1% | 5 sec |
| Manual insertion | 98.0% | 0.5% | 2 sec |

In consideration of the relationship between the Vfumin and the extended period Th of the pressure heating shown in FIG. 3, it is arranged for the present embodiment to modify the Th as 5 seconds in the first embodiment for the extended period of the pressure heating in case of the cassette sheet supply, and the Th is set as 2 seconds for the extended period of the pressure heating in case of the manual sheet supply.

Now, in conjunction with the flowchart shown in FIG. 9, a description will be made of the sequence of the main body control in accordance with the present embodiment.

From the reception of printing signal to the monitoring of the thermistor temperature, the same execution is made as the first embodiment (step S10 to step S14). Also, during this period, the sheet is supplied (step S15), and on standby in the position of the pre-feeding sensor 23 (step S16).

Then, for the present embodiment, the sheet supply opening is detected when the sheet is supplied, and when the monitored result of the thermistor temperature becomes more than the pre-feeding temperature Tpf° C. (170° C. in accordance with the present embodiment), the temperature adjustment mode is confirmed (step S17). If the mode is for the first run in the morning, the sheet size is examined (step S18). Then, if the size of the supplied sheet is legal size or universal size, the Th is decided depending on the designation of the sheet supply opening (step S30).

Here, on the assumption that the pressure heating extended period for the manual tray designation Th is set as 2, and that the pressure heating extended period for the cassette designation Th is set as 5, for example, the timer counting is initiated when the monitored result of the thermistor temperature becomes more than 170° C., and the temperature adjustment is continued for Th seconds at 170° C. (step S19 and step S20). Then, when the timer counting has elapsed the Th seconds, the sheet is again carried from the position of the pre-feeding sensor (step S21). At the same time, the heater temperature adjustment is initiated (step S22) to the temperature of the fixation temperature adjustment. After the sheet has passed the resist sensor (step S23), the image formation is started (step S24) to transfer images onto the sheet, and then, fixation is executed (step S25).

On the other hand, if the temperature adjustment mode is the usual one or the size of the supplied sheet is the one other than the legal size or the universal size, the temperature adjustment is allowed to shift to the fixing temperature adjustment as it is (step S22) when the detected thermistor temperature becomes 170° C. or the size of the supplied sheet has been examined. At the same time, the sheet is carried, and the image formation is performed (step S21 to step S24). Then, the fixation is executed (step S25).

When the fixation is completed, the power supply to the heater is turned off (step S26) if there is no reception of next printing signal.

With the sequence described above, the legal size sheets are supplied from the cassette and the manual insertion openings, respectively, for the confirmation of performance. No image scrubbing has taken place at all for the sheet supplied from either sheet supply openings, and good results are obtained. Also, the influences of the back tension exerted on the supplied sheet are not present on the latter half of the sheet. Therefore, there are no image problems, such as half tone density unevenness, thick images of characters, caused by the pulling force exerted by the back tension.

As described above, when printing is performed by raising the fixing apparatus from the condition of the first run in the morning, it is possible to avoid any image problems by means of the minimum extension of the fast printing time corresponding to each of the sheet supply openings by modifying the heating period of the pressure roller depending on the size of supplied sheet and the sheet supply opening currently in use.

(Third Embodiment)

Now, in conjunction with FIG. 10 and FIG. 11, the description will be made a third embodiment in accordance with the present invention. In this respect, the same reference marks are applied to the parts shared by those appearing in the first embodiment. Therefore, the description thereof will be omitted.

For the present embodiment, a monitoring means is provided for the pressure roller 11 in order to monitor the peripheral speeds thereof. Then, an example is shown, in which the heating period of the pressure roller is modified in accordance with the detected results of the peripheral speed of the pressure roller 11 and the size of supplied sheet.

The factors that may cause the changes of the peripheral speed of the pressure roller 11 are the variation of the outer diameter of pressure rollers at when manufactured, in addition to the thermal expansion of the elastic layer of the pressure roller 11 that brings about a greater variation of the peripheral speed as described earlier.

The variation of the peripheral speed caused by the variation of the outer diameter of the pressure rollers when manufactured is 0.5%/0.1 mm for the pressure roller whose outer diameter is 20 mm, for example. In order to reliably prevent images from being scrubbed due to the difference in the sheet conveying speeds between the transfer and fixation, it is necessary to suppress the changes of the peripheral speeds of the pressure roller 11, which may be caused by the variation of its outer diameter. For that matter, the smaller tolerance should be set for the finish of the outer diameters. Then, the production yield of the pressure rollers becomes unfavorable when being manufactured, leading to the increased costs thereof.

However, in accordance with the present embodiment, the actual measurement is made possible with respect to the peripheral speeds of the pressure roller 11. This measurement enables the detection of the variation of outer diameter thereof at the same time. As a result, there is an advantage that the outer diameter tolerance can be established more easily when the pressure rollers are finished in the manufacture thereof.

Figure 10:
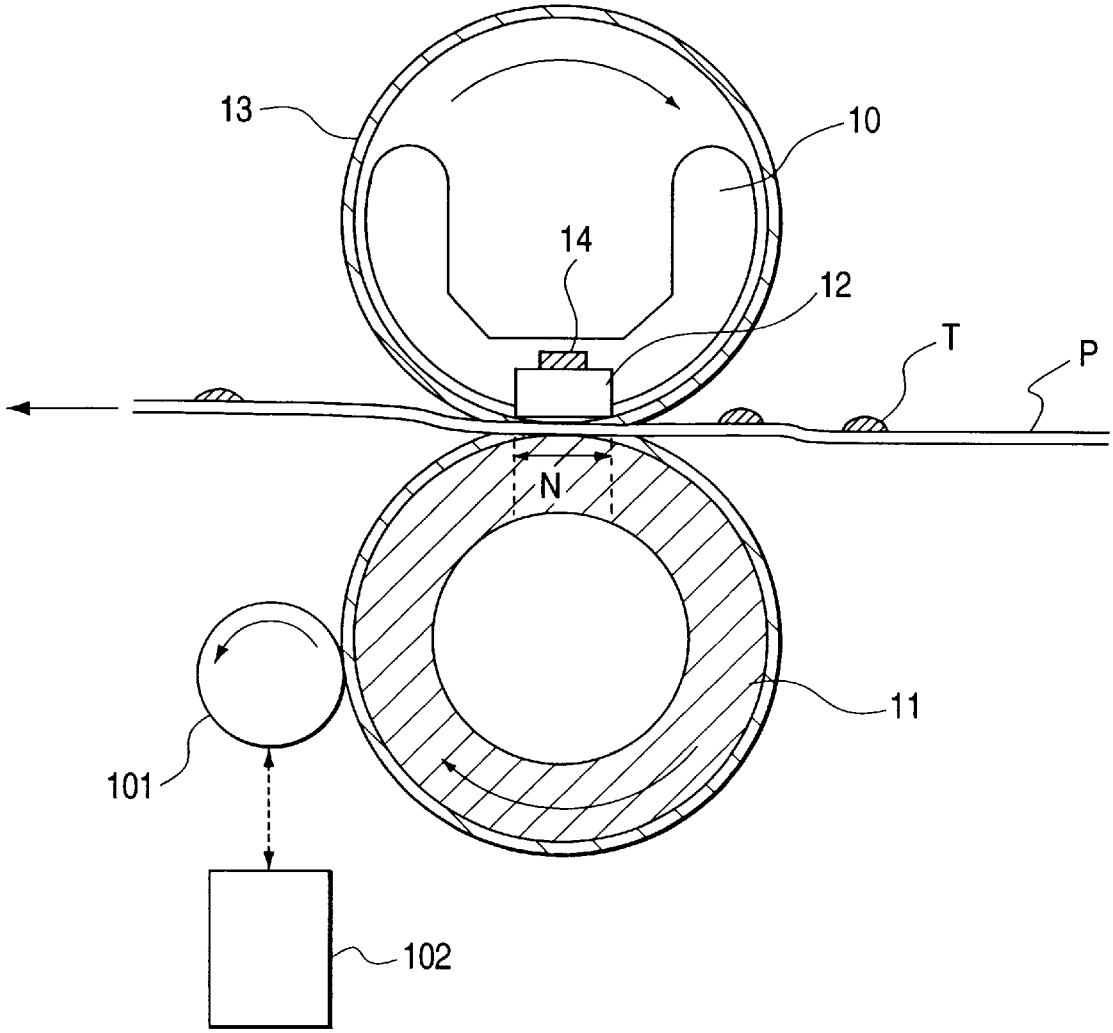
FIG. 10 is a view which schematically shows the structure of a film heating type fixing apparatus in accordance with a third embodiment of the present invention.
Figure 11:
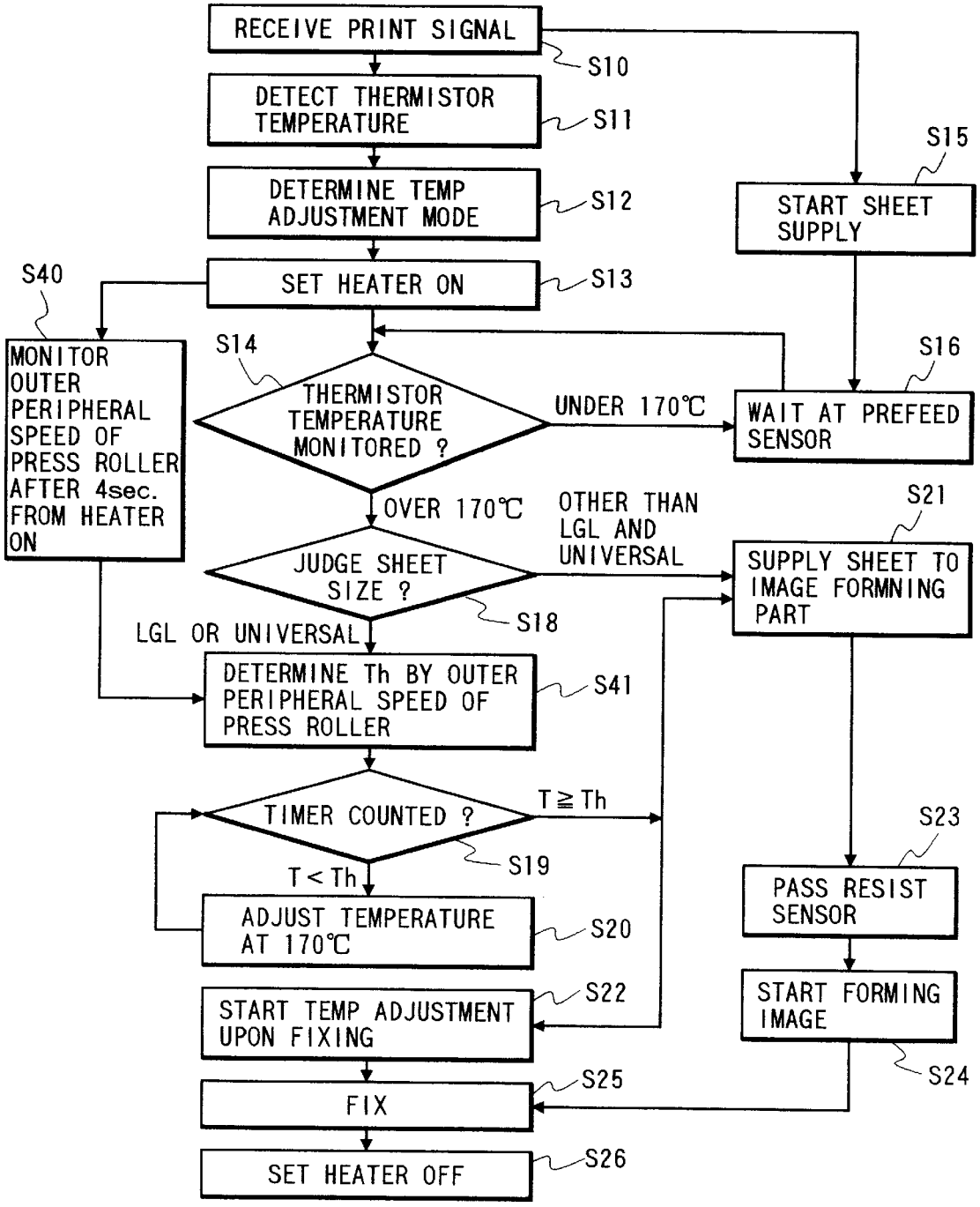
FIG. 11 is a flowchart which shows the control of the main body in accordance with the third embodiment of the present invention.

FIG. 10 is a cross-sectional view schematically showing a film heating type fixing apparatus having a pressure roller driving method to which the present embodiment is applicable. In this respect, the same reference marks are applied to the same parts appearing in the embodiments described above. Therefore, the description thereof will be omitted.

In FIG. 10, a reference numeral 101 designates a rotating body formed by metal or the like, which abuts upon the pressure roller 11 and rotates by following the rotation of the pressure roller. The peripheral speed of the pressure roller is calculated by means of a reflection sensor 102 which monitors the revolution of the follower roller 101.

In accordance with the present embodiment, depending on the monitored results of the peripheral speeds of the pressure roller, the extended period Th of the pressure heating is determined in accordance with the Table 4. When the size of supplied sheet is the legal one, the heating period of the pressure roller is extended from the usual period by +Th.

TABLE 4

| Peripheral speed of pressure roller | Th [sec] |
|---|---|
| 97.5%~ | 5 |
| 98.0%~ | 3 |
| 98.25%~ | 1 |
| 98.5% or more | 0 |

In this respect, the values Th shown on the Table 4 are the one for use of the pressure roller whose structure is the same as that of the embodiment described above. The values Th may be adjusted appropriately depending on the structure of a pressure roller to be used, as well as on the speeds set for the transfer and fixing portions.

Now, in conjunction with the flowchart shown in FIG. 11, the description will be made of the sequence of the main body control in accordance with the present embodiment. From the reception of printing signal to the monitoring of the thermistor temperature, the performance is carried out in the same manner as the two embodiments described above (step S10 to step S14). Also, during this period, the sheet is supplied (step S15), and on standby in the position of the pre-feeding sensor (step S16).

Further, in accordance with the present embodiment, the peripheral speed of the pressure roller is monitored after four seconds since the heater is turned on (step S40), and depending on the monitored peripheral speed of the pressure roller, the extended period Th of the pressure heating is determined (step S41).

Then, after the thermistor temperature has arrived at the temperature of the pre-feeding temperature adjustment Tpf= 170° C., the size of the supplied sheet is examined (step S18). If it is legal size or universal size, the pressure roller is idly rotated at 170° C. for Th seconds (step S19 and step S20). After the Th period has elapsed, the sheet is again carried to initiate the image formation (step S21 to step S24). At the same time, the temperature adjustment is allowed to shift to the fixing temperature adjustment for the execution of fixation (step S22 to step S25).

In this respect, if the Th is equal to 0, the temperature adjustment is switched over to the temperature adjustment upon fixation immediately after the temperature adjustment upon rising has arrived at 170° C. upon rising.

As described above, the heating period is set for the pressure roller on the basis of the result of the actual measurement of the peripheral speed of the pressure roller in accordance with the present embodiment. It is possible to grasp the condition of the pressure roller upon rising accurately, hence executing more precise control of the intended performance.

(Fourth Embodiment)

Now, in conjunction with FIG. 12, a description will be made a fourth embodiment in accordance with the present invention. In this respect, the same reference marks are applied to the parts shared by those appearing in the first embodiment. Therefore, the description thereof will be omitted.

In accordance with the present embodiment, the extended period of the pressure heating is determined by the detected result of the peripheral speed of the pressure roller, as well as by the size of the supplied sheet, and then, the extended period of the pressure heating is corrected depending on the sheet supply openings.

For the present embodiment, the extended period Th for the pressure heating is also determined in accordance with the Table 4 used for the third embodiment, and in accordance with the sheet supply opening to be used, correction is made on the Th value thus determined.

Now, in conjunction with the flowchart shown in FIG. 12, the description will be made of the sequence of the main body control in accordance with the present embodiment.

From the reception of printing signal to the monitoring of the thermistor temperature, the performance is carried out in the same manner as the two embodiments described above (step S10 to step S14). Also, during this period, the sheet is supplied (step S15), and on standby in the position of the pre-feeding sensor (step S16). Further, after four seconds since the heater is turned on, the peripheral speed of the pressure roller is monitored (step S40). Then depending on the monitored result of the peripheral speed of the pressure roller, the extended period of the pressure heating is determined (step S41). In accordance with the present embodiment, however, the sheet supply openings are examined here (in step S50). In other words, if the size of the supplied sheet is the legal one, the extended period Th of the pressure heating is determined from the monitored result of the peripheral speed of the pressure roller (step S41). If the sheet supply opening is a cassette, the pressure roller is caused to rotate idly for the Th seconds at 170° C. to be heated on the basis of by such Th period of extension (step S19 and step S20). After the Th period has elapsed, the sheet is again carried, and the heat adjustment is switched over to the heat adjustment upon fixation, hence executing the fixation (step S22 to step S25).

However, if the sheet supply opening is the manual insertion tray, the value, which is arrived at by subtracting two seconds from the Th value, is adopted for as the extended period of the pressure heating (step S50 and step S51). Then, the pressure roller idly rotates for such Th to be heated, thus executing the fixation (step S19 to step S25).

For the other sizes of supplied sheet, the temperature adjustment is switched over to the temperature adjustment upon fixation immediately after the temperature adjustment has reached 170° C. upon rising, thus executing the fixation.

As described above, the heating period of the pressure roller is set on the basis of the result of actual measurement of the outer peripheral speed of the pressure roller, and the heating period is corrected depending on the sheet supply openings. Therefore, it becomes possible to grasp the condition of the pressure roller upon rising accurately, thus executing more precise control for the intended performance.

(Fifth Embodiment)

Now, in conjunction with FIG. 13 to FIG. 16, the description will be made of a fifth embodiment in accordance with the present invention. In this respect, the same reference marks are applied to the parts shared by those appearing in the first embodiment. Therefore, the description thereof will be omitted.

In the embodiments described above, the difference in the conveying speeds between the transfer and fixation is all adjusted by means of the adjustment of the heating period of the pressure roller upon rising of the fixing apparatus. In accordance with the present embodiment, however, an example is shown, in which the correction of the difference in the conveying speeds between the transfer and fixation is made by adjusting the conveying speed in the transfer portion by switching the back tensions exerted on the supplied sheet.

Figure 13:
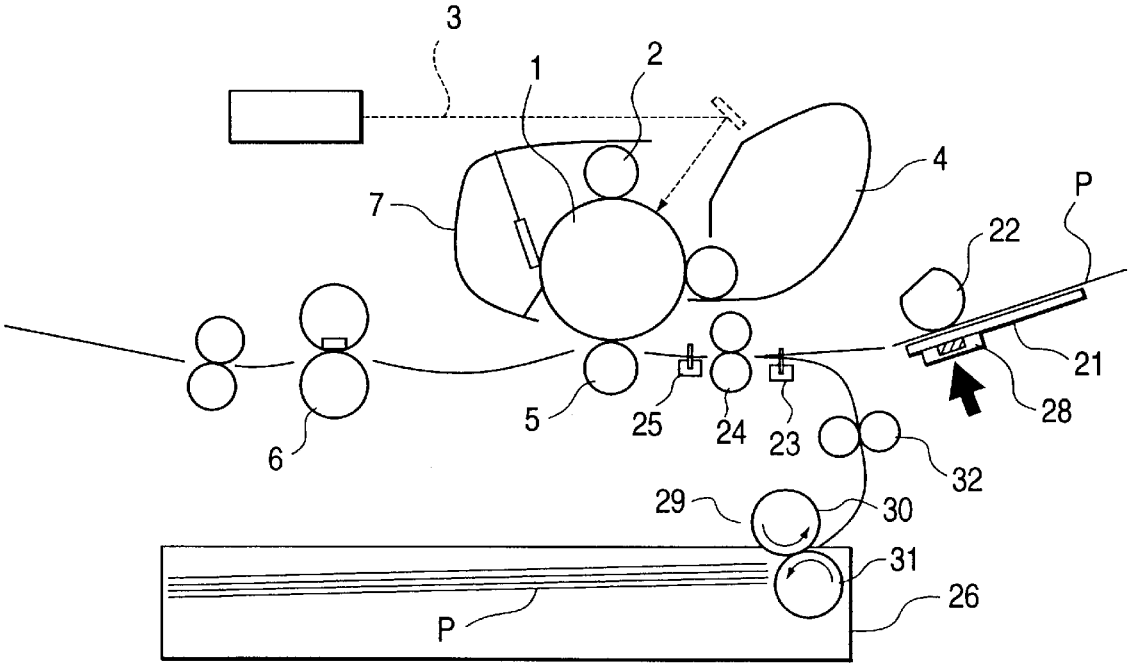
FIG. 13 is a view which schematically shows the structure of an image forming apparatus in accordance with a fifth embodiment of the present invention.

FIG. 13 is a cross-sectional view schematically showing the image forming apparatus to which the present embodiment is applicable. In this respect, the same reference marks are applied to the parts that have been already described in the above-mentioned embodiments. Therefore, the description thereof will be omitted.

In FIG. 13, a reference numeral 29 designates a pair of cassette sheet supply rollers of a retard type formed by a pair of rollers, that is, a feed roller 30 and a retard roller 31 which is driven by the feed roller 30 in the direction opposite to the sheet supplying direction through the arrangement of gears. The feed roller 30 is driven to rotate, and controlled by use of cassette sheet supply driving means (not shown).

A reference numeral 22 designates a sheet supply roller for a manual insertion tray (hereinafter referred to as MPT) 21, which performs the sheet supply from the MPT. Below the MPT sheet supply roller 22 that has pinched a paper sheet P serving as a recording material, a separation pad 28 is arranged to be in contact with the MPT sheet supply roller 22 by means of a spring (not shown). This separation pad is provided with a felt pad or some other member having a high friction coefficient, which is bonded under pressure to the surface of the pad that faces the supplied sheet. Here, a mechanism is arranged so that the sheet P is picked up from the MPT 21 by means of the MPT sheet supply roller 22, and by the function of the separation pad 28, only one sheet is fed to the downstream side of the feed roller 24. Also, a mechanism is arranged for the separation pad 22 to release the pad pressure after the sheet has been supplied.

For the image forming apparatus shown in FIG. 13, the distance between the cassette sheet supply roller 29 and the transfer nipping unit is 135 mm, while the distance between the MPT sheet supply roller 22 and the transfer nipping unit is 175 mm. The length of the conveying path between the transfer and fixation is 140 mm.

The Table 5 shows the measurement results of the speeds of the leading portion of each supplied sheet in the transfer unit when legal sized sheets (each having a dimension of 216×365 mm) are supplied from each of the sheet supply openings, cassette and MPT, of the image forming apparatus described above.

TABLE 5

| | B.T. released | B.T. added |
|---|---|---|
| Cassette | 100% | 99.3% |
| MPT | 100% | 99.6% |

Figure 14A:
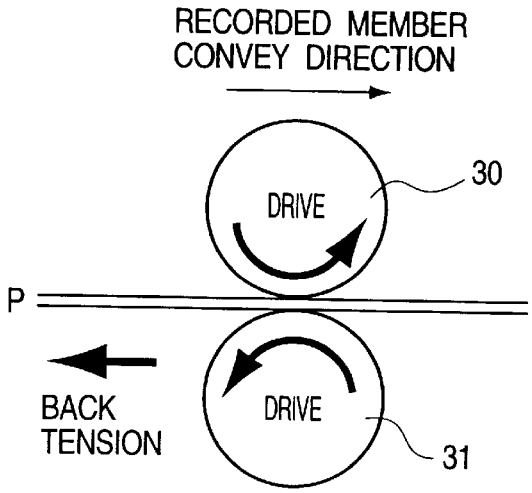
FIGS. 14A, 14B, 14C and 14D are views which illustrate the back tension exerted by a sheet supply unit.
Figure 14B:
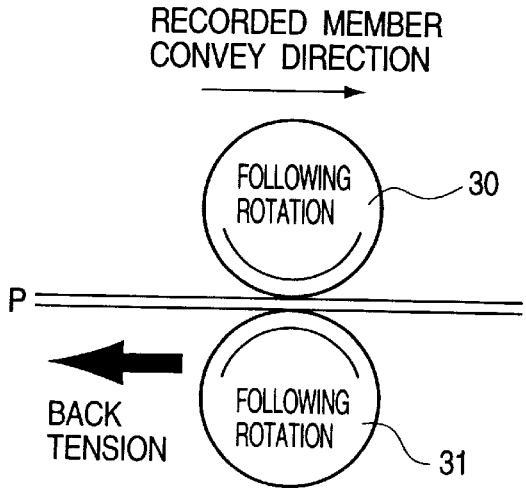
Figure 14C:
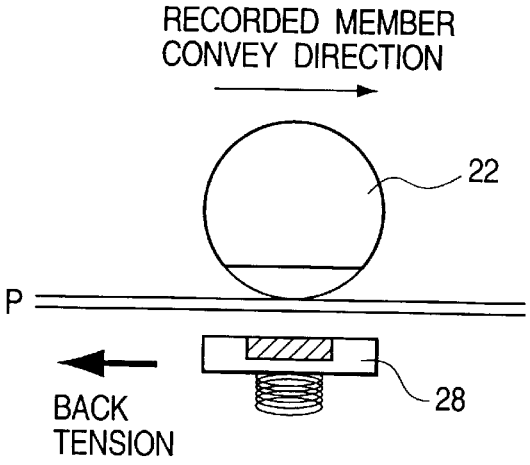
Figure 14D:
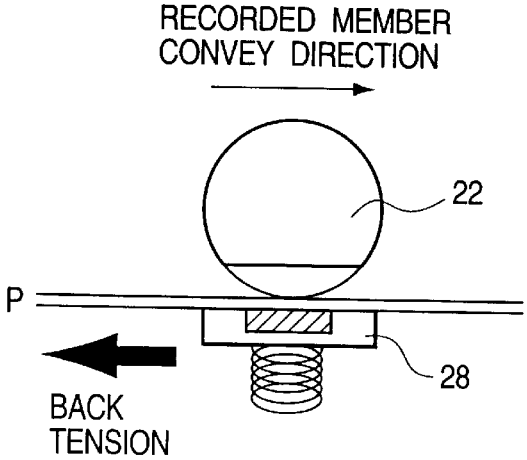

In the above table, the "B.T.released" means that when the sheet is supplied from the cassette (FIG. 14A), the feed roller 30 remains in the state of being driven to rotate after the sheet is supplied by means of the cassette sheet feed roller pair until the sheet is carried to have passed the cassette sheet feed roller pair completely. In this case, almost no back tension is exerted by means of the retard roller 31 on the sheet carried in the direction indicated by an arrow in FIG. 14A. On the contrary, if the rotational driving of the feed roller 30 is suspended after the sheet has been carried to the carrier roller immediately after the cassette sheet supply (FIG. 14B), the back tension is exerted strongly on the sheet by means of the following rotation of the feed roller 30 in the direction opposite to the sheet conveying direction. This situation is represented in the table 5 as "B.T.added". In case of the MPT sheet supply, the "B.T. released" means that the separation pad 28 is released (FIG. 14C) after the sheet is carried to the carrier roller immediately after it has been picked up by means of the MPT sheet supply roller 22. The "B.T. added" means that the sheet conveyance is performed, while the separation pad 28 is left in the state where it is in contact with the sheet under pressure (FIG. 14D).

The conveying speeds on the front half of the supplied sheet are made different when the back tension is released or added in such a manner as described above.

Figure 15:
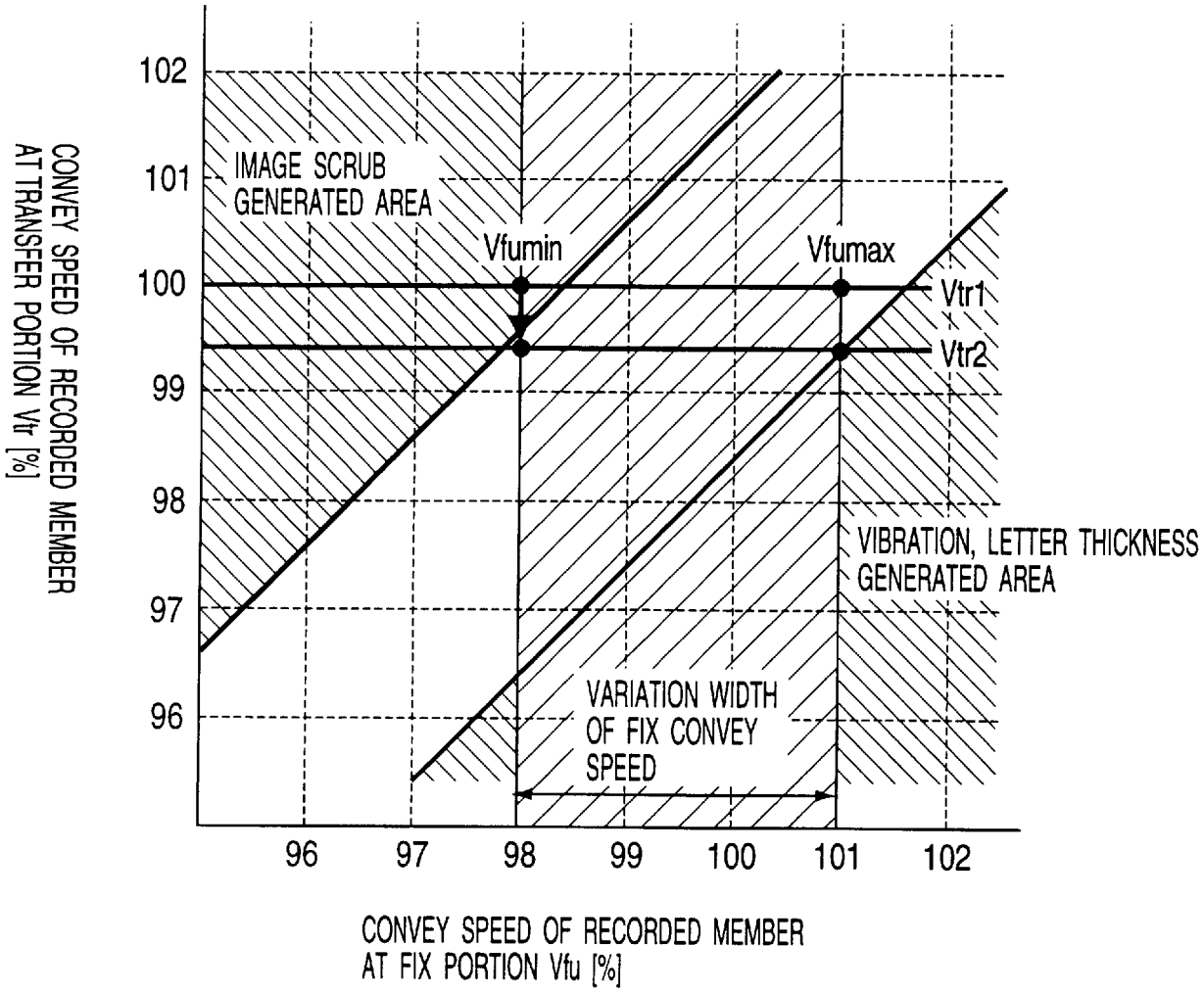
FIG. 15 is a graph which illustrates the transfer material conveying speeds in the transfer and fixing portions, and the area where the image problems are created in accordance with the fifth embodiment of the present invention.

FIG. 15 is a view which shows the area where the image problems may take place due to the sheet conveying speeds in the transfer portion Vtr and in the fixing portion Vfu, and also, due to the difference in speeds between the transfer and fixation.

When the Vfumin is set at 98%, the pressure roller is not thermally expanded as shown in FIG. 15. Here, immediately after rising of the fixing apparatus, the conveying speed is slower in the fixing portion. Therefore, the back tension is added to the supplied sheet to make the conveying speed in the transfer portion the same as shown at Vtr2 in FIG. 15. After the conveying speed in the fixing portion is increased to a certain extent, the back tension is released from the supplied sheet to make the conveying speed in the transfer portion the same as shown at Vtr1 in FIG. 15. In this way, it becomes possible to avoid image scrubbing, image blur, or the like in any of the speed differences between the transfer and fixation.

For the present embodiment, the Vfumin is set at 98% upon fixation, and the sheet supply driving system is controlled to allow the back tension to be exerted on the first to tenth sheets when the sheet supply is initiated in the first run in the morning condition. Then, the back tension is released on the eleventh sheet and on, thus continuing the sheet supply.

Figure 16:
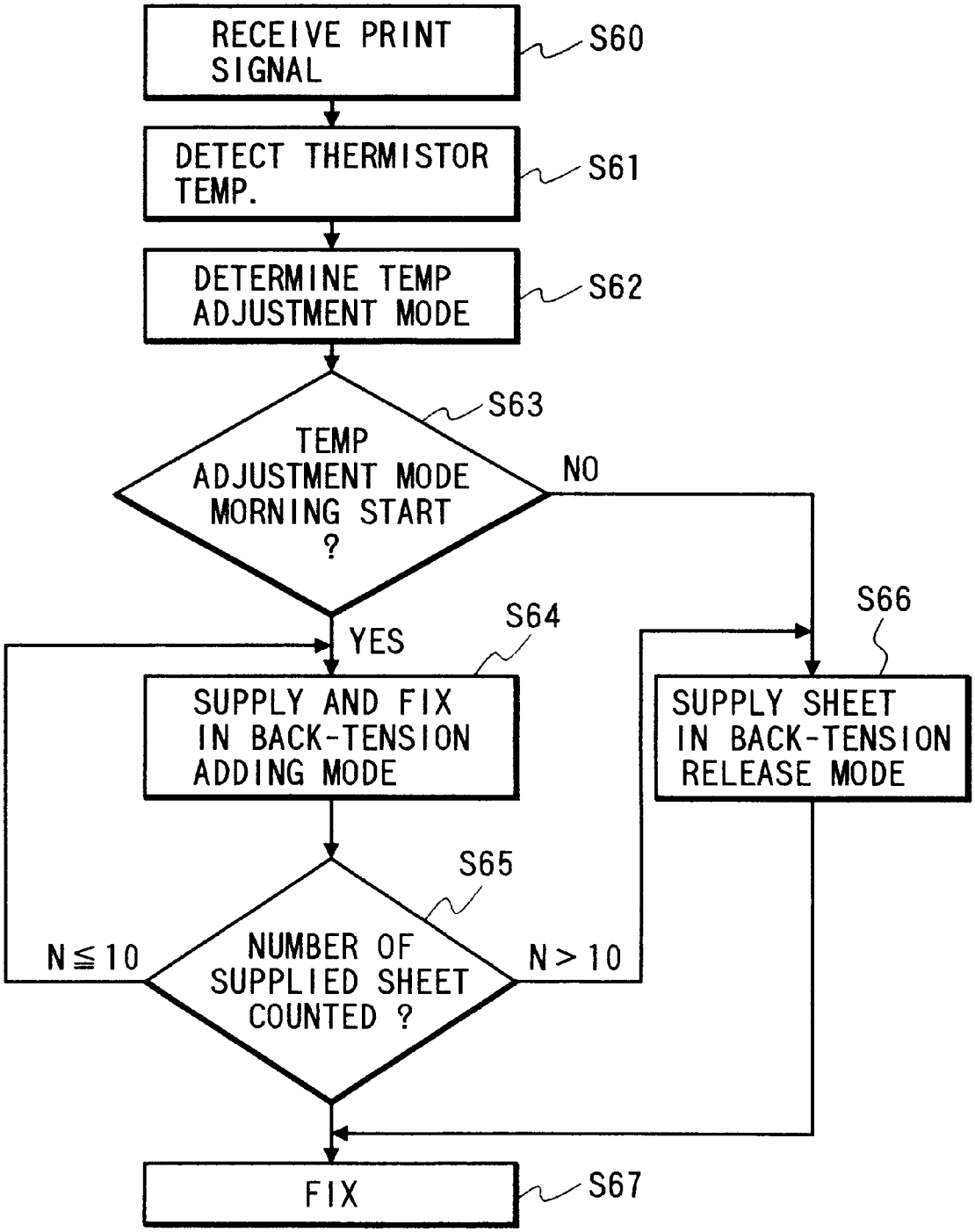
FIG. 16 is a flowchart which shows the control of the main body in accordance with the fifth embodiment of the present invention.

Now, in conjunction with the flowchart shown in FIG. 16, the description will be made of the sequence of the main body control in accordance with the present embodiment.

After the reception of printing signal (step S60), the thermistor temperature is detected (step S61). With the examination on whether or not the current condition is in the first run in the morning state, the temperature adjustment mode is determined, thus starting the control of power supply to the heater (step S62). Subsequently, the temperature adjustment mode is examined (step S63). If the temperature adjustment mode is in the condition of the first run in the morning, each sheet is supplied under the "back tension added" mode for fixation (step S64). At the same time, the counting of the numbers of supplied sheets begins (step S65).

After that, when the numbers of supplied sheets thus counted exceed ten, the sheet supply mode is switched over to the "back tension released" mode (step S66), and the printing is continued (step S67).

Also, if there is the next printing signal received after the completion of fixation in either of the temperature adjustment modes, the printing is executed continuously. If no printing signals is received at that time, the power supply to the heater is turned off as in the above embodiments.

With the control described above, the fixing apparatus is caused to rise from the first run in the morning condition, and 400 each of legal size sheets are continuously supplied from the cassette and the MPT, respectively, for the confirmation of images thus formed. As a result, there are found no image problems, such as image scrubbing and image blur.

When the back tension is added, the images transferred on the sheet are slightly contracted. It may be possible to correct this contraction by adjusting image writing on the photosensitive drum corresponding to the switching of back tension between the added and released modes.

As described above, the sheet conveying speed is made slower in the transfer portion by adding the back tension to the supplied sheets from the first one to the designated numbers in order to prevent images from being scrubbed upon fixation in the condition of the first run in the morning. In this way, it is possible to set speeds within the entire range thereof for the prevention of the image problems that may be caused by the difference in the conveying speeds between the transfer and fixation. For the present embodiment, the heating period is not extended for the pressure roller unlike the previous embodiments. Therefore, it is possible to complete printing in the minimum time required for the fast printing in any case.

(Sixth Embodiment)

Figure 17:
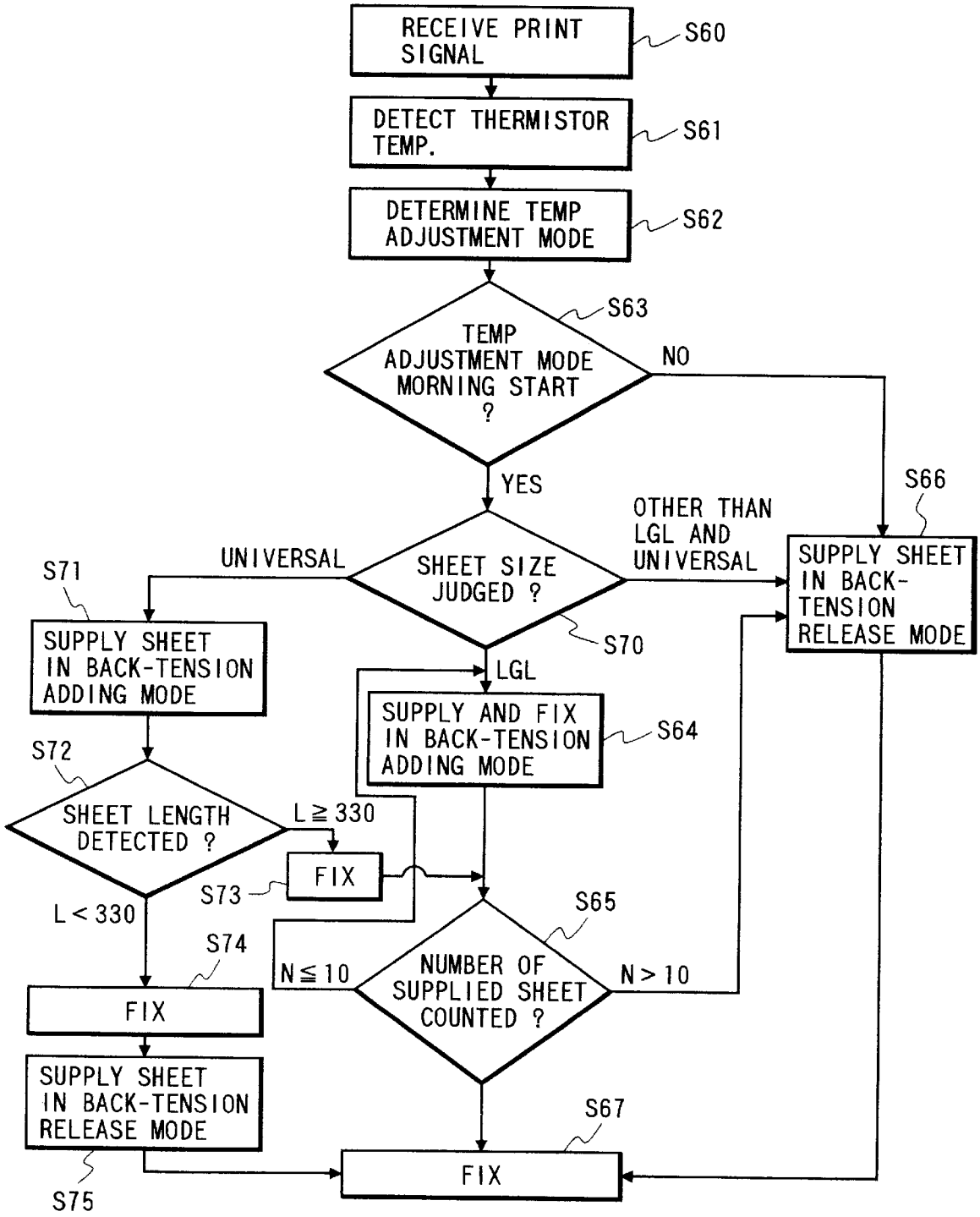
FIG. 17 is a flowchart which shows the control of the main body in accordance with a sixth embodiment of the present invention.

Now, in conjunction with FIG. 17, the description will be made of a sixth embodiment in accordance with the present invention. In this respect, the same reference marks are applied to the parts shared by those appearing in the fifth embodiment. Therefore, the description thereof will be omitted.

The description of the present embodiment is made using the same image forming apparatus shown in the fifth embodiment. In accordance with the present embodiment, the legal size sheet is detected in accordance with its cassette sizes, the sheet size designation from the host computer, or some other information, and the back tensions are switched over. However, if the universal size is designated, the length of such sheet is detected by means of the pre- feeding sensor. Depending on the detected results, the switching of the back tension is performed as in the case of the legal size sheet only when the detected sheet is long.

Now, in conjunction with the flowchart shown in FIG. 17, the description will be made of the sequence of the main body control in accordance with the present embodiment.

After the reception of printing signal (step S60), the thermistor temperature is detected (step S61). With the examination on whether or not the current condition is in the first run in the morning, the temperature adjustment mode is determined, thus starting the control of power supply to the heater (step S62). Subsequently, the temperature adjustment mode is examined (step S63). If the temperature adjustment mode is in the condition of the first run in the morning, the size of supplied sheet is examined (step S70) in accordance with the detection of the cassette sizes, information on the sheet size from the host computer or the like. If the examined result of the sheet is legal size or universal size, each sheet is supplied under the "back tension added" mode for fixation (step S64). At the same time, the counting of the numbers of supplied sheets begins (step S65). After that, when the numbers of supplied sheets thus counted exceed ten, the sheet supply mode is switched over to the "back tension released" mode (step S66), and the printing is continued (step S67).

Meanwhile, if the sheet is found to be universally sized as the result of sheet size examination (in the step S70), the first sheet is supplied in the mode of the "back tension added" (step S71). At the same time, the length of such sheet is detected (step S72). If the length is 330 mm or more, the sheet supply and fixation are continued up to the tenth sheet in the "back tension added" mode (step S64 and step S65) after the fixation of the first sheet (step S73).

On the other hand, if the detected length of the sheet is less than 330 mm, the mode is switched over to the "back tension released" on the second sheet on (step S75) after the fixation is made for the first sheet (step S74). After that, the fixing operation is executed (step S67).

In the cases other than these ones, all the sheet supplies are performed in the mode of the "back tension released" beginning with the first sheet. In either cases of temperature adjustment modes, the printing is continued if there is received the next printing signal after the completion of the current fixation. If not, the power supply to the heater is turned off.

With the execution of the control described above, it is possible to obtain the same effects as the above embodiment. At the same time, the sheet supply mode is corrected depending on the detected length of the supplied sheet. Therefore, it becomes possible to reduce the frequencies of making complicated corrections, such as to correct the contraction of the image magnification that may take place when the back tension is added or to correct the magnification or the like when images are written to compensate such image contraction.

(Seventh Embodiment)

Figure 18:
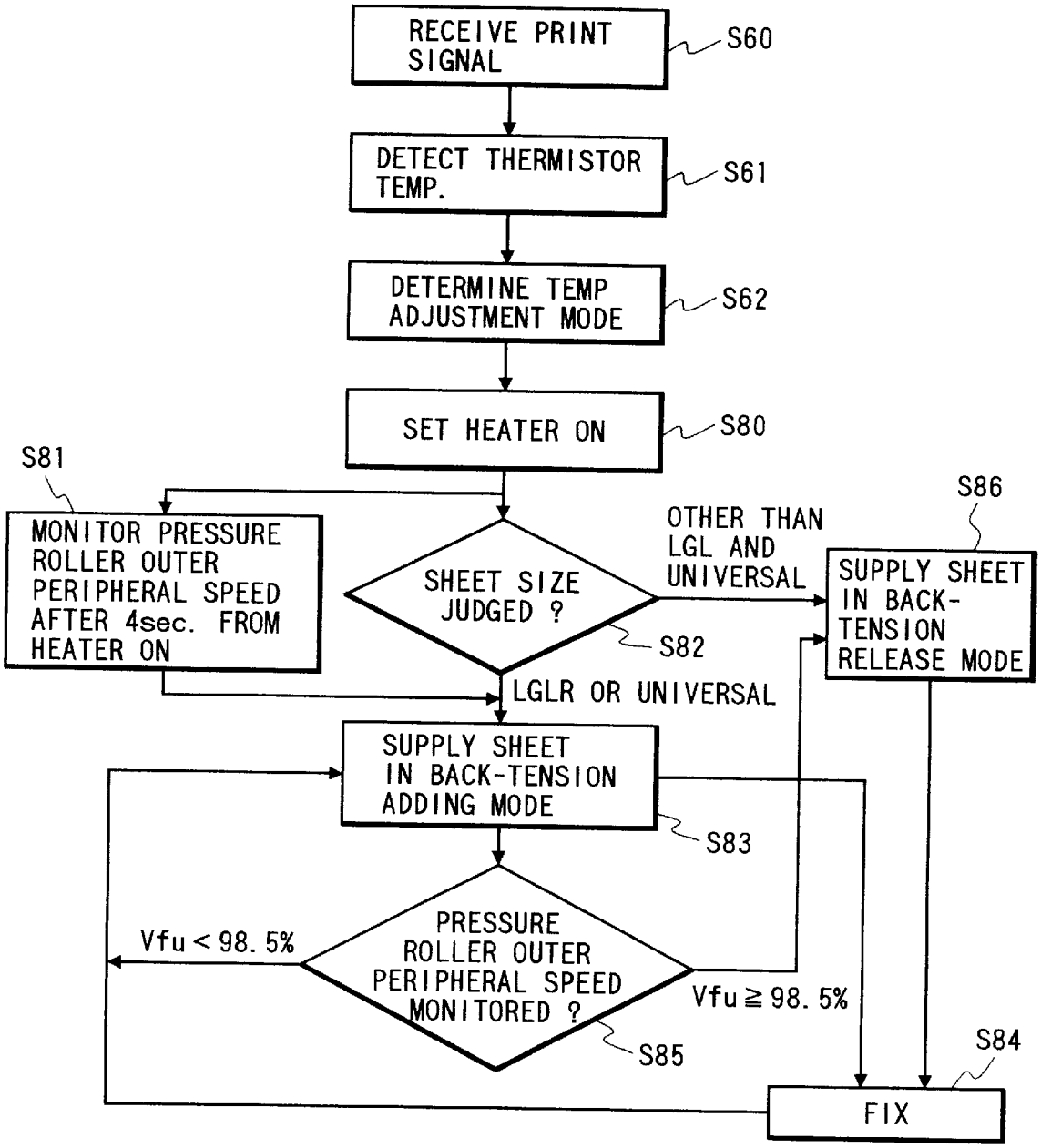
FIG. 18 is a flowchart which shows the control of the main body in accordance with a seventh embodiment of the present invention.
Figure 19:
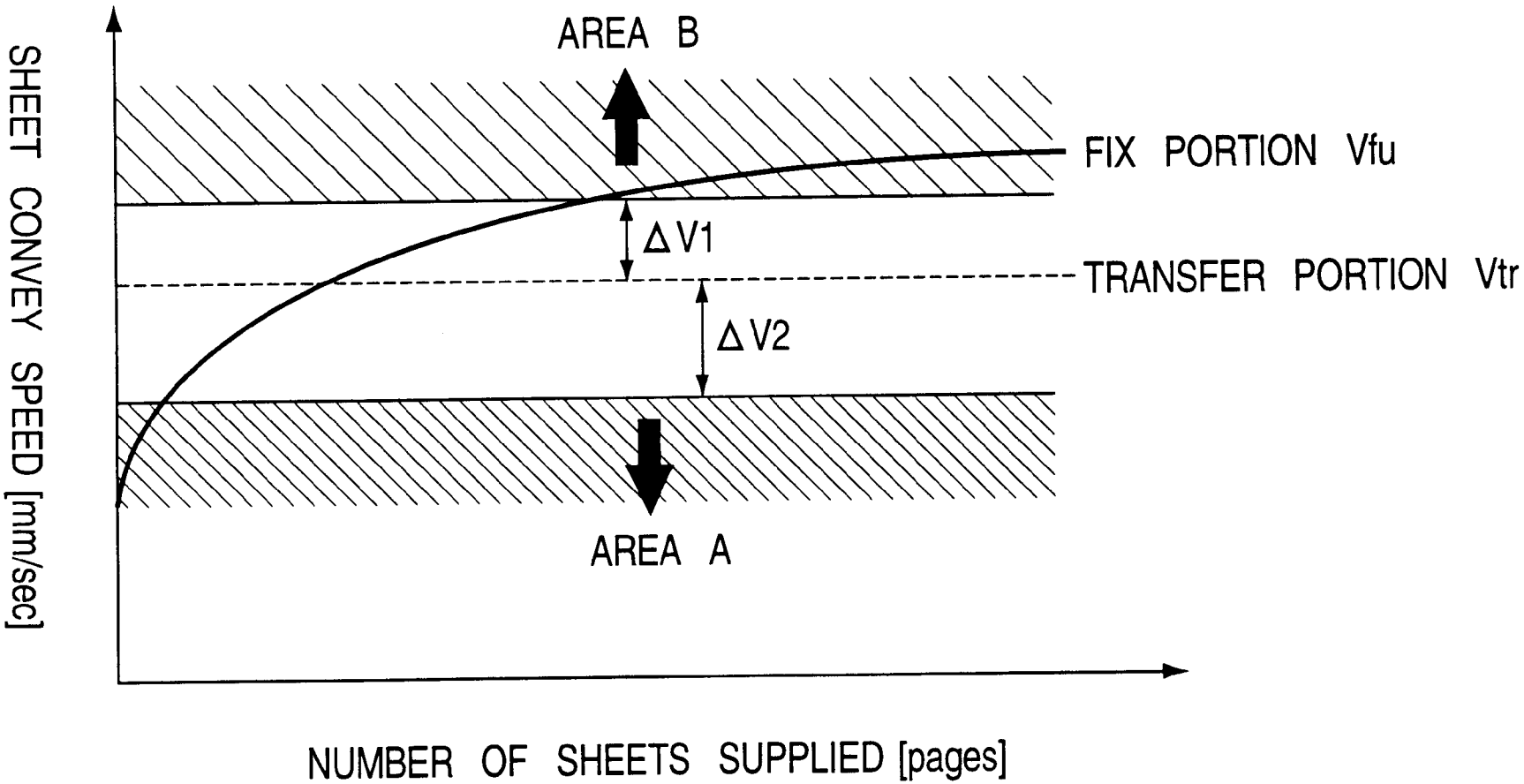
FIG. 19 is a graph which illustrates the transfer material conveying speeds in the transfer and fixing portions, and the area where the image problems are created in accordance with the conventional image forming apparatus.
Figure 20A:
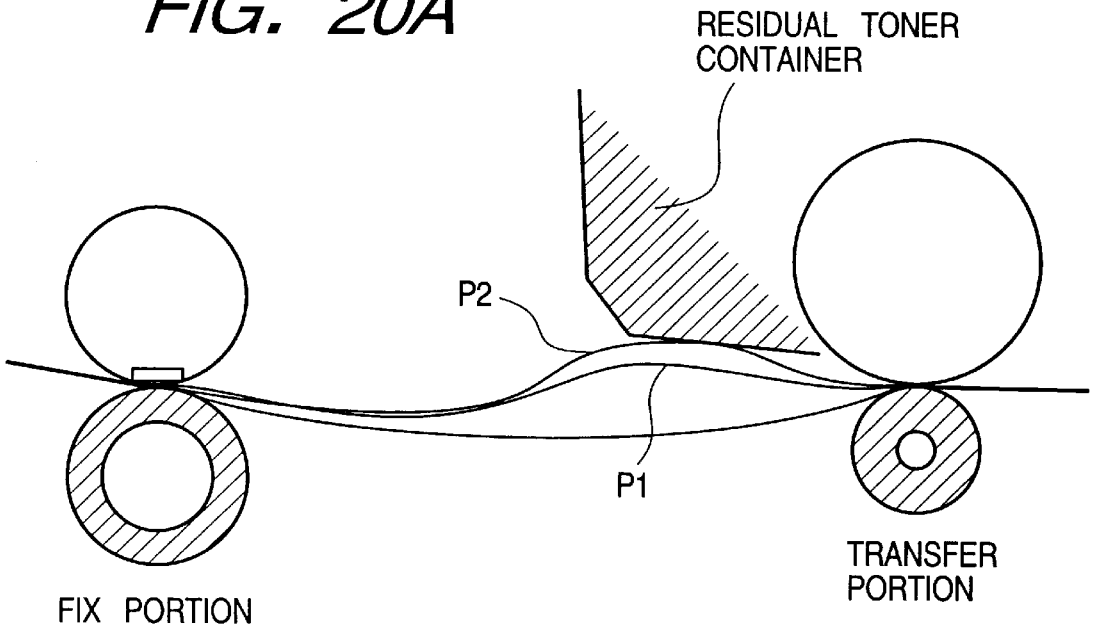
FIGS. 20A and 20B are views which illustrate the way in which the image problems are created.
Figure 20B:
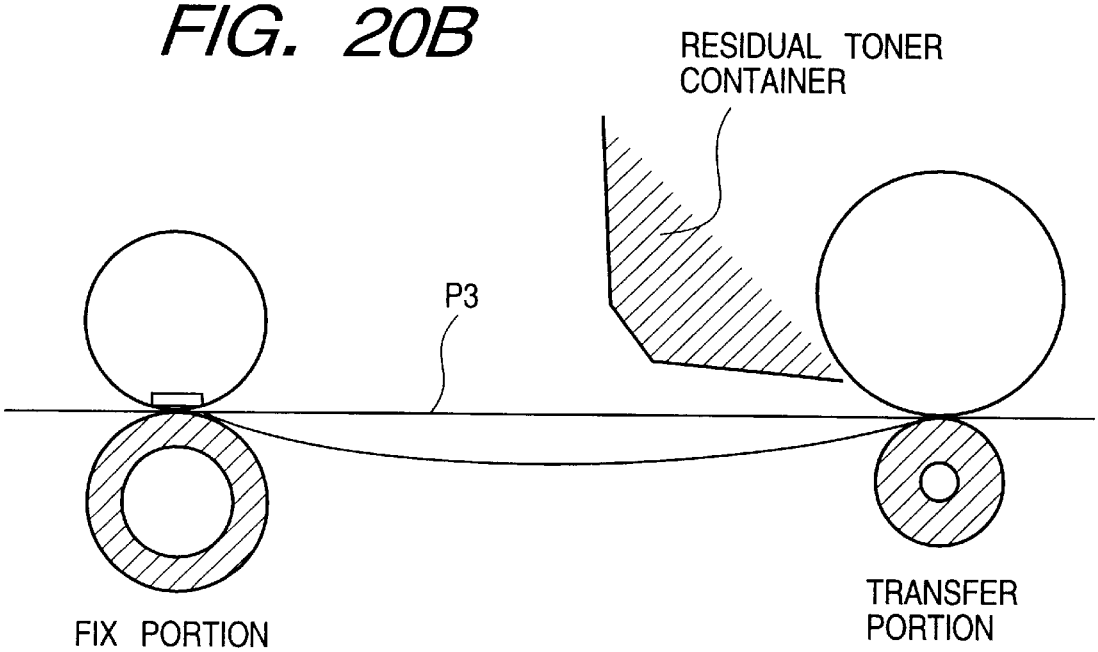

Now, in conjunction with FIG. 18, the description will be made of a seventh embodiment in accordance with the present invention. In this respect, the same reference marks are applied to the parts shared by those appearing in the first embodiment. Therefore, the description thereof will be omitted.

The present embodiment shows an example in which the speed difference between the transfer and fixation is corrected by switching the back tensions on a supplied sheet in accordance with the monitored results of the peripheral speed of the pressure roller.

For the present embodiment, the description will be made using the image forming apparatus whose structure is the same as that of the one shown in the fifth embodiment. Therefore, the description of the structure of the apparatus will be omitted. Also, the peripheral speeds of the pressure roller are monitored in the same method adopted for the fourth embodiment.

Now, in conjunction with the flowchart shown in FIG. 18, the description will be made of the sequence of the main body control in accordance with the present embodiment.

After the reception of printing signal (step S60), the temperature of the thermistor is detected (step S61) to examine whether or not the condition is in the first run in the morning. Then, the temperature adjustment mode is determined to begin energizing the heater (step S62). During this period, the sheet is supplied to be on standby in the position of pre-feeding sensor.

After that, when four seconds have elapsed since the heater is turned on (step S80), the peripheral speed of the pressure roller is monitored (step S81). At the same time, the size of the supplied sheet is examined in accordance with the detection of the cassette size, information on sheet size from the host computer, or the like (step S82). If the size of the supplied sheet is found to be legal size or universal size, the sheet is supplied in the "back tension added" mode (step S83) to execute fixation (step S84). At the same time, the peripheral speed of the pressure roller is monitored twice while the sheet is being carried (step S85). If the peripheral speed of the pressure roller is less than 98.5%, the sheet supply is continued in the "back tension added" mode. However, if the peripheral speed of the pressure roller is found to be 98.5% or more, the sheet supply mode is switched to the "back tension released" (step S86). Then, printing is continued (step S84).

In any cases other than these ones, the sheet supply is executed all in the "back tension released" mode beginning with the first sheet (step S86).

As described above, it becomes possible to make the optimized control of the transfer speeds by controlling the back tension application in accordance with the monitored results of the peripheral speed of the pressure roller.

The present invention is not necessarily limited to the specific embodiments described above. It is to be understood that the invention includes any variations of the same technical thought disclosed herein.

What is claimed is:

1. An image forming apparatus comprising:

image forming means for forming an image onto a recording material;

fixing means for fixing the image on the recording material, said fixing means having a heater and a rotating member for conveying the recording material, said rotating member being heated by said heater; and control means for controlling energization of said heater, wherein said control means controls an energizing period to said heater before starting a fixing operation in accordance with information relating to both of a peripheral speed of said rotating member and a size of the recording material.

2. An image forming apparatus according to claim 1, wherein said heater heats the image on the recording material, and said heater and said rotating member form a nip for nipping the recording material.

3. An image forming apparatus according to claim 1, wherein the information relating to the peripheral speed of said rotating member corresponds to a temperature of said heatet before starting the fixing operation, and said control means controls the energizing period to said heater before starting the fixing operation in accordance with both the temperature of said heater before starting the fixing operation and the size of the recording material.

4. An image forming apparatus according to claim 1, further comprising speed detecting means for detecting the peripheral speed of said rotating member, wherein said control means controls the energizing period to said heater before starting the fixing operation in accordance with both the peripheral speed of said rotating member detected by said speed detecting means and the size of the recording material.

5. An image forming apparatus according to claim 1, further comprising a plurality of sheet supply openings for supplying the recording material to said image forming means, and said control means controls the energizing period in accordance with information relating to the peripheral speed of the rotating member, the size of the recording material, and the supply opening used.

6. An image forming apparatus according to claim 3, wherein the temperature of said heater before starting the fixing operation is a temperature of said heater immediately after a print signal is received.

7. An image forming apparatus according to claim 3, wherein, when the temperature of said heater before starting the fixing operation is lower than a predetermined set temperature and the size of the recording material is larger than a predetermined size, said control means extends the energizing period to said heater before starting the fixing operation.

8. An image forming apparatus according to claim 7, wherein said control means controls an energization of said heater so that said heater is maintained at the predetermined set temperature during the extended energizing period.

9. An image forming apparatus according to claim 8, wherein the predetermined set temperature is lowet than a first printing temperature in the fixing operation.

10. An image forming apparatus according to claim 5, wherein said plurality of sheet supply openings include an opening for a cassette feed and an opening for a manual feed, and when the energizing period to said heater before starting the fixing operation is extended, an extended time period is shorter when the opening used is the opening for the manual feed rather than the opening for the cassette feed.

11. An image forming apparatus according to claim 4, wherein said control means extends the energizing period to sid heater before starting the fixing operation when the recording material is larger than a predetermined size and the peripheral speed of said rotating member detected by said speed detecting means is slower than a predetermined speed.

12. An image forming apparatus according to claim 11, further comprising a sheet supply opening for cassette fed and a sheet supply opeining for manual feed, wherein, when the energizing period to said heater before starting the fixing operation is extended, an extended time period is shorter when the opening used is the opening for the manual feed rather than the opening for the cassette feed.

13. An image forming apparatus comprising:

image forming means for forming an image onto a recording material at an image forming position;

fixing means for fixing the image on the recording material, said fixing means having a heater and a rotating member for conveying the recording material, said rotating member being heated by said heater; and control means for conrolling a moving speed of the recording material at the image forming position in accordance with information relating to both of a peripheral speed of said rotating member and a size of the recording material.

14. An image forming apparatus according to claim 13, wherein the information relating to the peripheral speed of said rotating member corresponds to a temperature of said heater before starting a fixing operation, and said control means controls the moving speed in accordance with both the temperature of said heater before starting the fixing operation and the size of the recording material.

15. An image forming apparatus according to claim 14, wherein said control means lowers the moving speed when the temperature of said heater before starting the fixing operation is lower than a predetermined set temperature and the size of the recording material is larger than a predetermined size.

16. An image forming apparatus according to claim 15, wherein when a plurality of recording materials are fixed continuously, said control means lowers the moving speed to a predetermined rate when the temperature of said heater before starting the fixing operation is lower than the predetermined set temperature and the size of the recording material is larger than the predetermined size.

17. An image forming apparatus according to claim 13, further comprising speed detecting means for detecting a peripheral speed of said rotating member, wherein said control means controls the moving speed in accordance with both the peripheral speed of said rotating member detected by said speed detecting means and the size of the recording material.

18. An image forming apparatus according to claim 17, wherein said control means lowers the moving speed when the peripheral speed of said rotating member detected by said speed detecting means is slower than a predetermined speed and the size of recording material is larfer than a predetermined size.

19. An image forming apparatus according to claim 18, wherein when a plurality of the recording materials are fixed continuously, said control means lowers the moving speed to a predetermined sheet number when the peripheral speed of said rotating member detected by said speed detecting means is slower than the predetermined speed and the size of the recording material is larger than a predetermined size.

20. An image foring apparatus according to claim 13, further comprising a recording material feeding means for feeding the recording material to the image forming position, wherein said control means controls the moving speed by controlling said recording material feeding means.

21. An image forming apparatus according to claim 20, wherein said recording material feeding means applies a tension to the recording material in a direction opposite to a moving direction when the moving speed is lowered.

22. An image forming apparatus according to claim 13, said image forming means controls an image forming speed in conformity with the moving speed.

23. An image forming apparatus comprising:

image forming means for forming an image onto a recording material at an image forming position;

recording material feeding means for feeding the recording material to the image forming position;

fixing means for fixing the image on the recording material, said fixing means having a heater and a rotating member for conveying the recording material, said rotating member being heated by said heater; and control means for controlling said recording material feeding means in accordance with both of information relating to a peripheral speed of said rotating member and a size of the recording material.

* * * * *

UNITED STATES PATENT AND TRADEMARK OFFICE

CERTIFICATE OF CORRECTION

PATENT NO. : 6,108,500

DATED : August 22, 2000

INVENTOR(S) : Yuko Ohkama et al

It is certified that error appears in the above-identified patent and that said Letters Patent is hereby corrected as shown below:

FIG. 12

"DETERNINE" should read --DETERMINE-- and "FORMNING" should read --FORMING--.

COLUMN 1

Line 18, "saving." should read --savings.--.

COLUMN 2

Line 15, "salutation" should read --saturation--; and
Line 57, "ΔV2," should read --ΔV2--.

COLUMN 5

Line 5, "serves" should read --serve--; and
Line 57, "being printed" should read --being printed using a--.

COLUMN 6

Line 10, "fluroro" should read --fluoro--;
Line 17, "is" should read --are--; and
Line 48, "if" should read --in--.

UNITED STATES PATENT AND TRADEMARK OFFICE

CERTIFICATE OF CORRECTION

PATENT NO. : 6,108,500

DATED : August 22, 2000

INVENTOR(S) : Yuko Ohkama et al

It is certified that error appears in the above-identified patent and that said Letters Patent is hereby corrected as shown below:

COLUMN 7

Line 3, "form" should read --from--;
Line 52, "to" should read --of--;
Line 57, "to" should read --of--; and
Line 58, "to" should read --of--.

COLUMN 8

Line 21, "apparatus" should read --apparatus is--.

COLUMN 9

Line 62, "cases" should read --case--.

COLUMN 12

Line 33, "a" should read --of a--; and
Line 46, "at" should be deleted.

COLUMN 13

Line 34, "one" should read --ones--.

UNITED STATES PATENT AND TRADEMARK OFFICE

CERTIFICATE OF CORRECTION

PATENT NO. : 6,108,500

DATED : August 22, 2000

INVENTOR(S) : Yuko Ohkama et al

It is certified that error appears in the above-identified patent and that said Letters Patent is hereby corrected as shown below:

COLUMN 14

Line 9, "a" should read --of a--;
Line 45, "by" should be deleted; and
Line 52, "for" should be deleted.

COLUMN 17

Line 4, "signals" should read --signal--.

COLUMN 20

Line 21, "sid" should read --said--;
Line 27, "fed" should read --feed--; and
Line 28, "opeining" should read --opening--.

COLUMN 21

Line 10, "larfer" should read --larger--.

Signed and Sealed this

Fifteenth Day of May, 2001

*Attest:*

Nicholas P. Godici

NICHOLAS P. GODICI

*Attesting Officer*

*Acting Director of the United States Patent and Trademark Office*